US006742866B2

(12) United States Patent
Anderson et al.

(10) Patent No.: US 6,742,866 B2
(45) Date of Patent: Jun. 1, 2004

(54) INK JET PRINT HEAD HAVING OFFSET NOZZLE ARRAYS

(75) Inventors: Frank Edward Anderson, Sadieville, KY (US); John Philip Bolash, Lexington, KY (US); Randall David Mayo, Georgetown, KY (US); George Keith Parish, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 69 days.

(21) Appl. No.: 10/217,018

(22) Filed: Aug. 12, 2002

(65) Prior Publication Data

US 2003/0076381 A1 Apr. 24, 2003

Related U.S. Application Data

(62) Division of application No. 09/499,008, filed on Feb. 4, 2000.

(51) Int. Cl.[7] ..... B41J 2/15
(52) U.S. Cl. ..... 347/40; 347/41; 347/43
(58) Field of Search ..... 347/40, 41, 43, 347/12, 42

(56) References Cited

U.S. PATENT DOCUMENTS

| | | | | |
|---|---|---|---|---|
| 5,349,375 A | * | 9/1994 | Bolash et al. | 347/40 |
| 5,734,394 A | * | 3/1998 | Hackleman | 347/42 |
| 6,024,436 A | * | 2/2000 | Katakura et al. | 347/40 |
| 6,097,409 A | | 8/2000 | Murakami | |

FOREIGN PATENT DOCUMENTS

JP 09-309201 12/1997

* cited by examiner

*Primary Examiner*—Lamson D Nguyen
(74) *Attorney, Agent, or Firm*—Luedeka, Neely & Graham, P.C.; Jacqueline M. Daspit, Esq.

(57) ABSTRACT

An ink jet printing apparatus forms a printed image on a print medium based on image data. The apparatus includes an ink jet print head having ink ejection nozzles in a nozzle array. Ink is ejected from the nozzles and onto the print medium as the print head scans across the print medium in a scan direction, thereby forming the image on the print medium. The nozzle array on the print head includes a first substantially columnar array of nozzles aligned with a print medium advance direction which is perpendicular to the scan direction. The first array has a first upper subarray pair that includes a first upper left and a first upper right subarray of nozzles. The first upper left and a first upper right subarrays each include a substantially linear arrangement of n number of nozzles having equal nozzle-to-nozzle spacings. The nozzle-to-nozzle spacing in the first upper right subarray is equivalent to the nozzle-to-nozzle spacing in the first upper left subarray. The first upper right subarray is offset from the first upper left subarray in the scan direction by a first horizontal spacing, and is offset in the print medium advance direction by one-half of the nozzle-to-nozzle spacing. The nozzle array also includes a second substantially columnar array of nozzles aligned with the print medium advance direction. The second array is offset from the first array in the scan direction by a second horizontal spacing, and is offset in the print medium advance direction by one-fourth of the nozzle-to-nozzle spacing. The second columnar array has a second upper subarray pair that includes a second upper left and a second upper right subarray. The second upper left and second upper right subarrays each include a substantially linear arrangement of n number of nozzles having equal nozzle-to-nozzle spacings. The second upper right subarray is offset from the second upper left subarray in the scan direction by the first horizontal spacing and in the print medium advance direction by one-half of the nozzle-to-nozzle spacing.

12 Claims, 32 Drawing Sheets

INK JET PRINT HEAD HAVING OFFSET NOZZLE ARRAYS

This is a division of Ser. No. 09/499,008, filed Feb. 4, 2000.

FIELD OF THE INVENTION

The present invention is generally directed to an ink jet printing apparatus. More particularly, the invention is directed to an ink jet print head having horizontally and vertically offset arrays of inkjet nozzles.

BACKGROUND OF THE INVENTION

Ink jet printers form images on a print medium by ejecting droplets of ink from nozzles in a print head as the print head translates across the print medium. The nozzles are generally arranged in one or more columns that are aligned orthogonally to the direction of translation of the print head.

In previous print head designs having two columns of nozzles, each nozzle in each column has been horizontally aligned with a corresponding nozzle in the other column. With at least two horizontally-aligned nozzles that are operable to print dots in the same row as the print head translates across the print medium, such designs provide redundancy. If one nozzle fails, the other nozzle can print dots that would have been printed by the failed nozzle.

In previous dual-column designs vertical spacing, or pitch, between nozzles in each column has typically been limited to 1/300 inch. With these previous print heads, 1/300 inch is as fine a vertical resolution as is possible during a single pass of the print head. Printing a 600 dots per inch (dpi) checkerboard pattern with such a print head requires a 1/600 inch vertical movement of the print medium between two consecutive passes of the print head. Thus, these previous print heads are not capable of printing a 600 dpi checkerboard pattern in a single pass.

Further, in printers having two print cartridges, such as a black and a color cartridge, the vertical misalignment between the print heads on the two cartridges can be as much as 1/600 inch where the vertical pitch between nozzles in each print head is 1/300 inch. Such large vertical misalignment results in degradation of printed image quality.

Therefore, an improved print head that is capable of printing a 600 dpi checkerboard pattern in a single pass of the print head, and that provides for more accurate alignment between multiple print heads is needed.

SUMMARY OF THE INVENTION

The foregoing and other needs are met by an ink jet printing apparatus for forming a printed image on a print medium based on image data. The apparatus includes a printer controller for receiving the image data and for generating print signals based on the image data. The apparatus also includes an ink jet print head having ink ejection nozzles in a nozzle array and a corresponding number of ink heating elements. The print head receives the print signals and selectively activates the heating elements based on the print signals. This causes ink to be ejected from the corresponding nozzles and onto the print medium as the print head scans across the print medium in a scan direction, thereby forming the image on the print medium.

The nozzle array on the print head includes a first substantially columnar array of nozzles that is aligned with a print medium advance direction which is perpendicular to the scan direction. The first array has a first upper subarray pair that includes a first upper left and a first upper right subarray of nozzles. The first upper left and first upper right subarrays each include a substantially linear arrangement of n number of nozzles having equal nozzle-to-nozzle spacings. The nozzle-to-nozzle spacing in the first upper right subarray is equivalent to the nozzle-to-nozzle spacing in the first upper left subarray. The first upper right subarray is offset from the first upper left subarray in the scan direction by a first horizontal spacing, and is offset in the print medium advance direction by one-half of the nozzle-to-nozzle spacing.

The nozzle array also includes a second substantially columnar array of nozzles that is aligned with the print medium advance direction. The second array is offset from the first array in the scan direction by a second horizontal spacing, and is offset in the print medium advance direction by one-fourth of the nozzle-to-nozzle spacing. The second columnar array has a second upper subarray pair that includes a second upper left subarray and a second upper right subarray. The second upper left and second upper right subarrays each include a substantially linear arrangement of n number of nozzles having equal nozzle-to-nozzle spacings. The second upper right subarray is offset from the second upper left subarray in the scan direction by the first horizontal spacing and in the print medium advance direction by one-half of the nozzle-to-nozzle spacing.

In preferred embodiments, the printer controller of the apparatus is operable to generate the print signals to activate the heating elements to cause ink to be ejected from the nozzles in the first upper left subarray to form first dots in a first column on the print medium. The spacing between the first dots is equivalent to the nozzle-to-nozzle spacing in the first upper left subarray. The printer controller also generates the print signals to cause ink to be ejected from the nozzles in the first upper right subarray, thus forming second dots in the first column that are collinear and interdigitated with the first dots. The spacing between the second dots is equivalent to the nozzle-to-nozzle spacing in the first upper right subarray. The printer controller is further operable to generate the print signals to cause ink to be ejected from the nozzles in the second upper left subarray to form third dots in a second column on the print medium. The spacing between the third dots is equivalent to the nozzle-to-nozzle spacing in the second upper left subarray. The printer controller additionally generates the print signals to cause ink to be ejected from the nozzles in the second upper right subarray, thereby forming fourth dots in the second column that are collinear and interdigitated with the third dots. The spacing between the fourth dots is equivalent to the nozzle-to-nozzle spacing in the second upper right subarray. The third and fourth dots are offset in the print medium advance direction from the first and second dots by one-quarter of the nozzle-to-nozzle spacing in the subarrays. The third and fourth dots are also offset in the scan direction from the first and second dots by at least one-quarter of the nozzle-to-nozzle spacing.

Thus, as the print head makes one pass across the print medium while printing the first, second, third, and fourth dots as described above, the invention prints a checkerboard pattern of dots

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
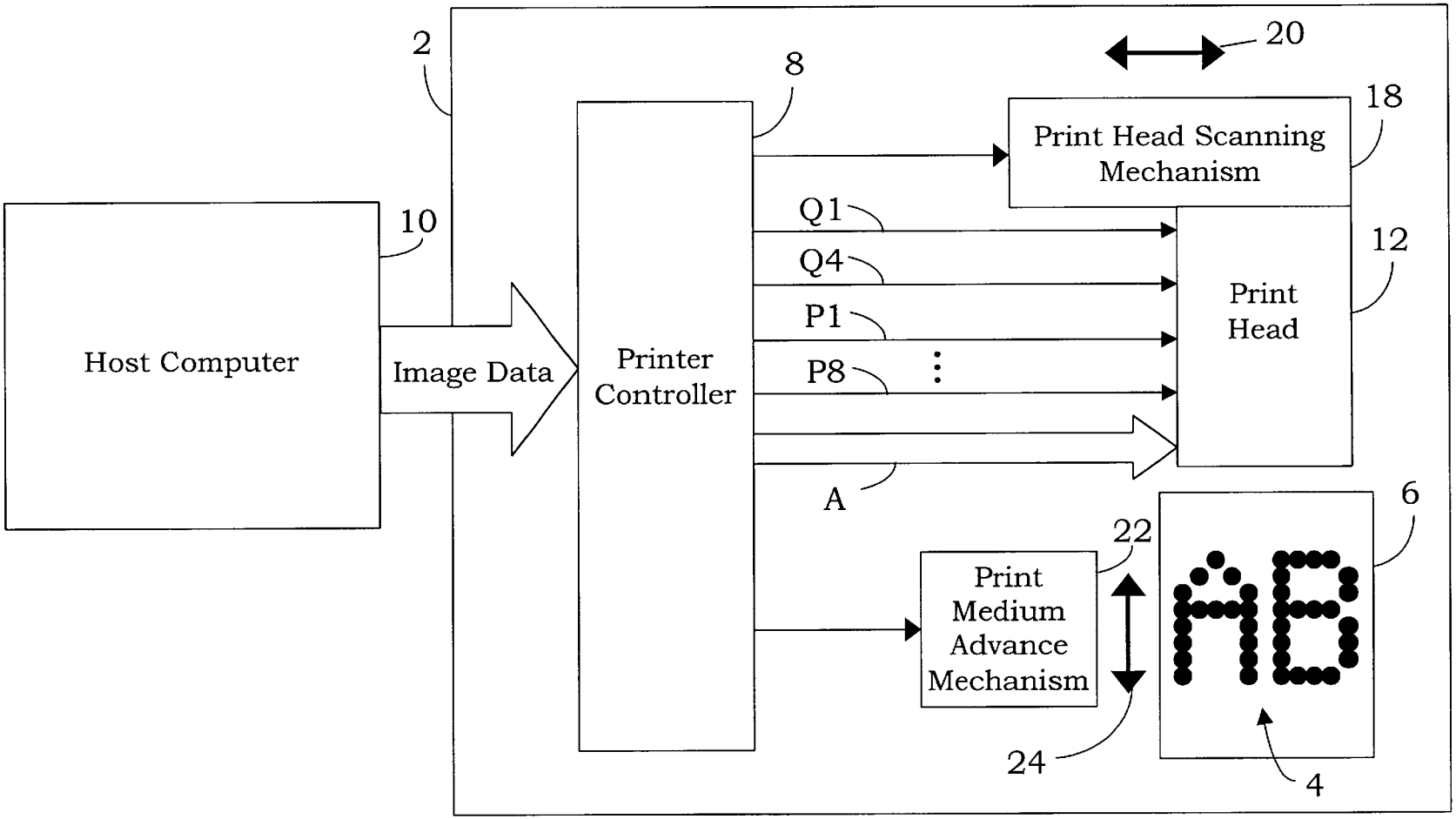
FIG. 1 is a functional block diagram of an ink jet printer according to a first embodiment of the invention.

Shown in FIG. 1 is an ink jet printer 2 for printing an image 4 on a print medium 6. The printer 2 includes a printer controller 8, such as a digital microprocessor, that receives image data from a host computer 10. Generally, the image data generated by the host computer 10 describes the image 4 in a bit-map format. Such a format represents the image 4 as a collection of pixels, or picture elements, in a two-dimension rectangular coordinate system. For each pixel, the image data indicates whether the pixel is on or off (printed or not printed), and the rectangular coordinates of the pixel on the print medium 6. Typically, the host computer 10 "rasterizes" the image data by dividing the image 4 into horizontal rows of pixels, stepping from pixel-to-pixel across each row, and writing out the image data for each pixel according to each pixel's order in the row. Based on the image data, the printer controller 8 generates print signals, scan commands, and print medium advance commands, as described in more detail below.

Figure 2:
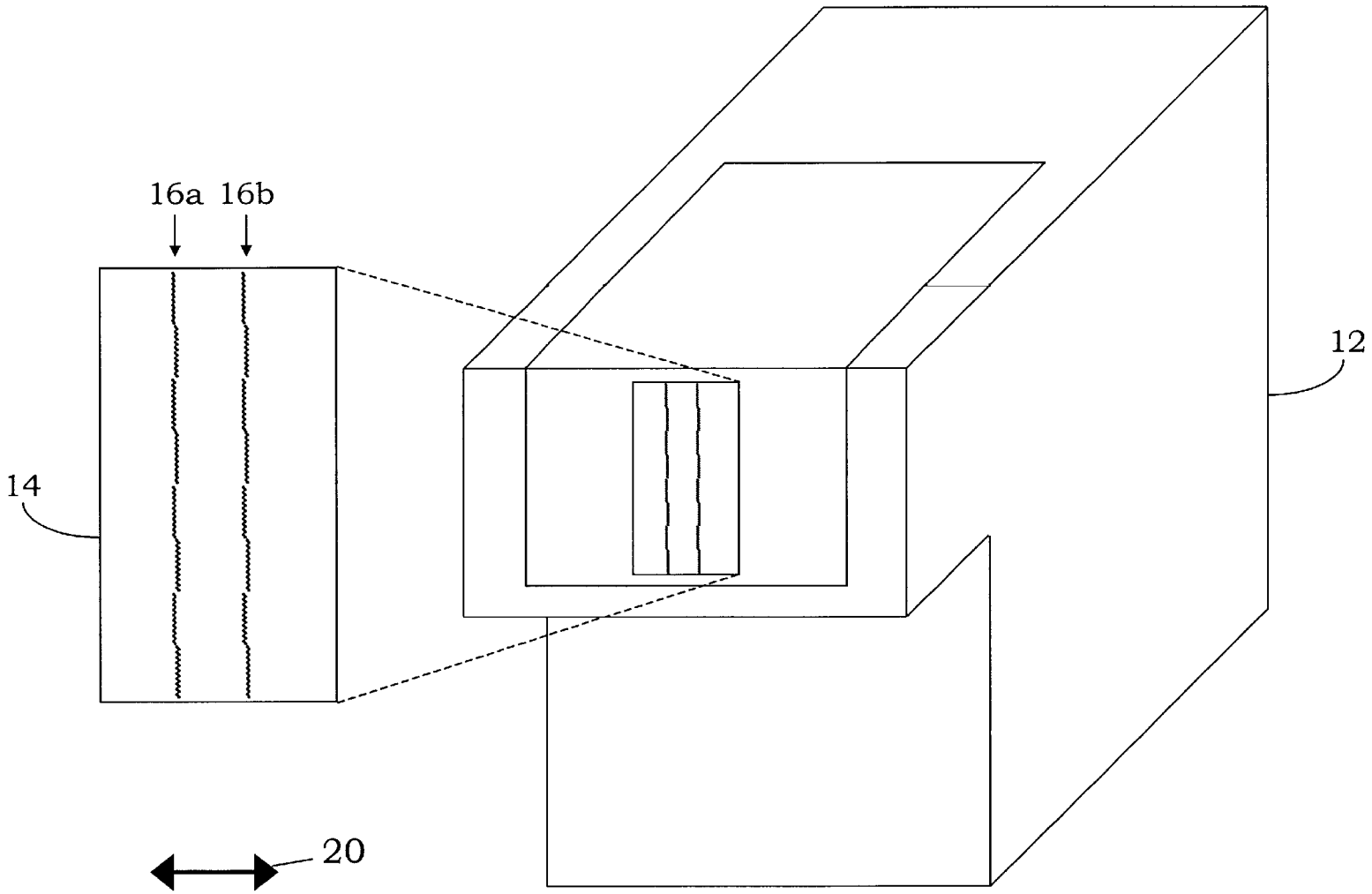
FIG. 2 depicts an ink jet print head according to a preferred embodiment of the invention.

As shown in FIGS. 1 and 2, the printer 10 includes a print head 12 that receives the print signals from the printer controller 8. On the print head 12 is a thermal ink jet heater chip covered by a nozzle plate 14. Within the nozzle plate 14 are nozzles situated in a nozzle array consisting of first and second substantially columnar arrays 16*a* and 16*b*. Based on the print signals from the printer controller 8, ink droplets are ejected from selected nozzles in the arrays 16*a* and 16*b* to form dots on the print medium 6 corresponding to the pixels in the image 4. Ink is selectively ejected from a nozzle when a corresponding heating element on the heater chip is activated by the print signals from the controller 8.

Figure 3A:
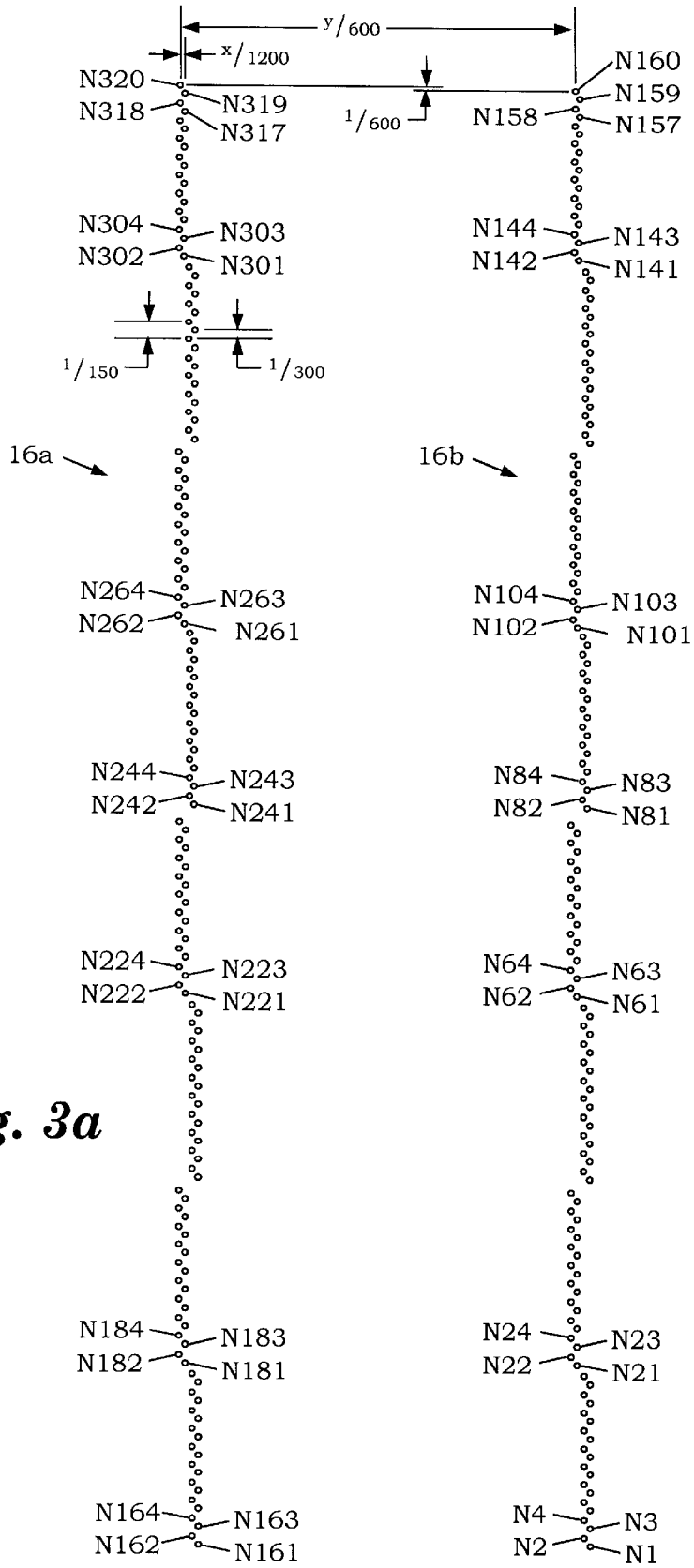
FIG. 3*a* depicts first and second columnar arrays of ink jet nozzles on the print head according to a preferred embodiment of the invention.

FIG. 3*a* depicts a preferred embodiment of the arrangement of nozzles N1–N320 in the nozzle plate 14. Array 16*b* includes the nozzles N1–N160, and array 16*a* includes the nozzles N161–N320. Preferably, nozzle-to-nozzle spacings in the two arrays 16*a* and 16*b* are identical. However, the array 16*a* is vertically offset from the array 16*b* by 1/600 inch. Arrays 16*a* and 16*b* are horizontally separated by a second horizontal spacing of y/600 inch, where y is an odd integer. In the preferred embodiment of the invention, y is 17.

Figure 3B:
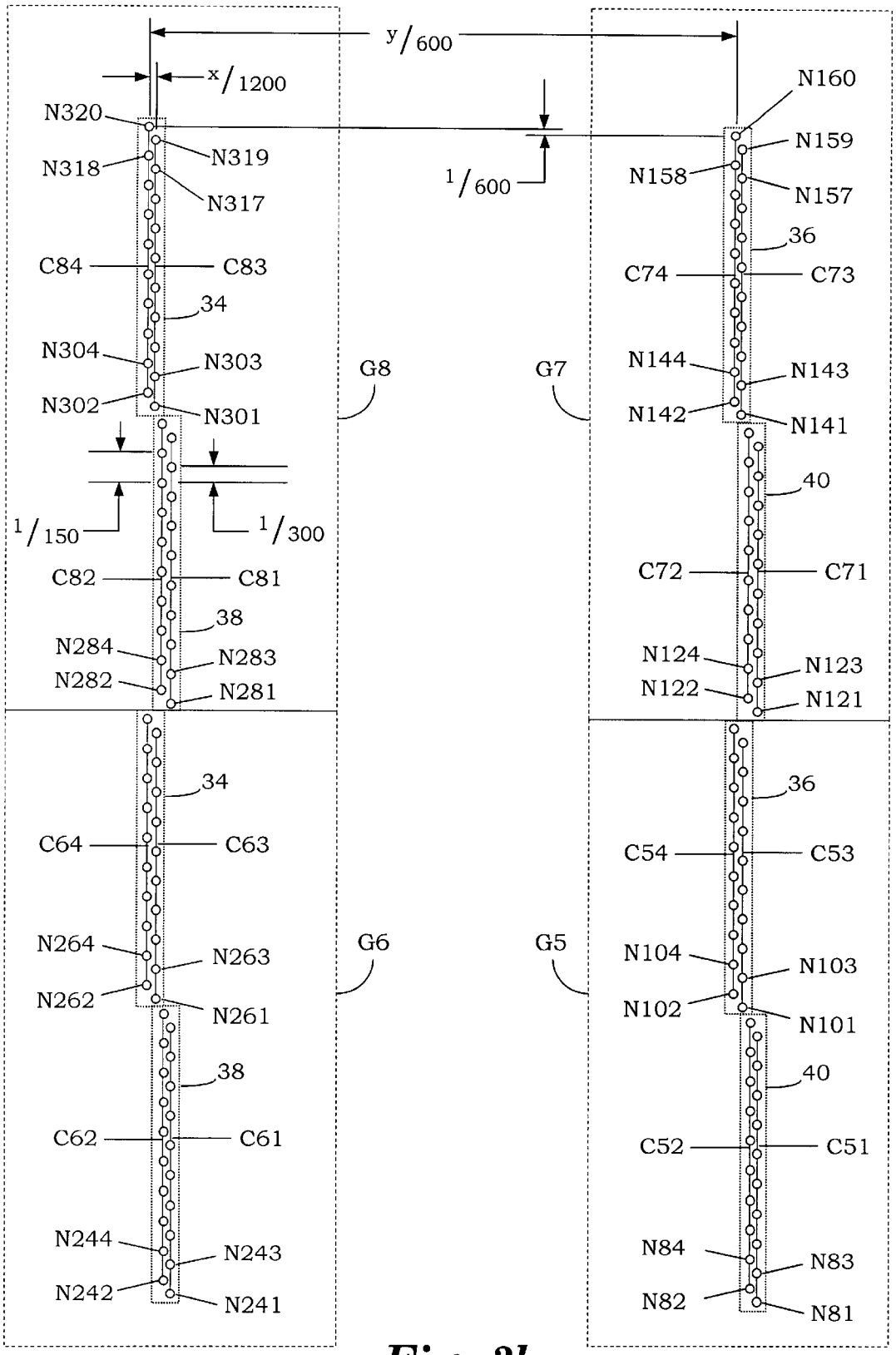
FIG. 3*b* depicts a more detailed view of the upper half of the first and second columnar arrays of ink jet nozzles according to the first embodiment of the invention.
Figure 3C:
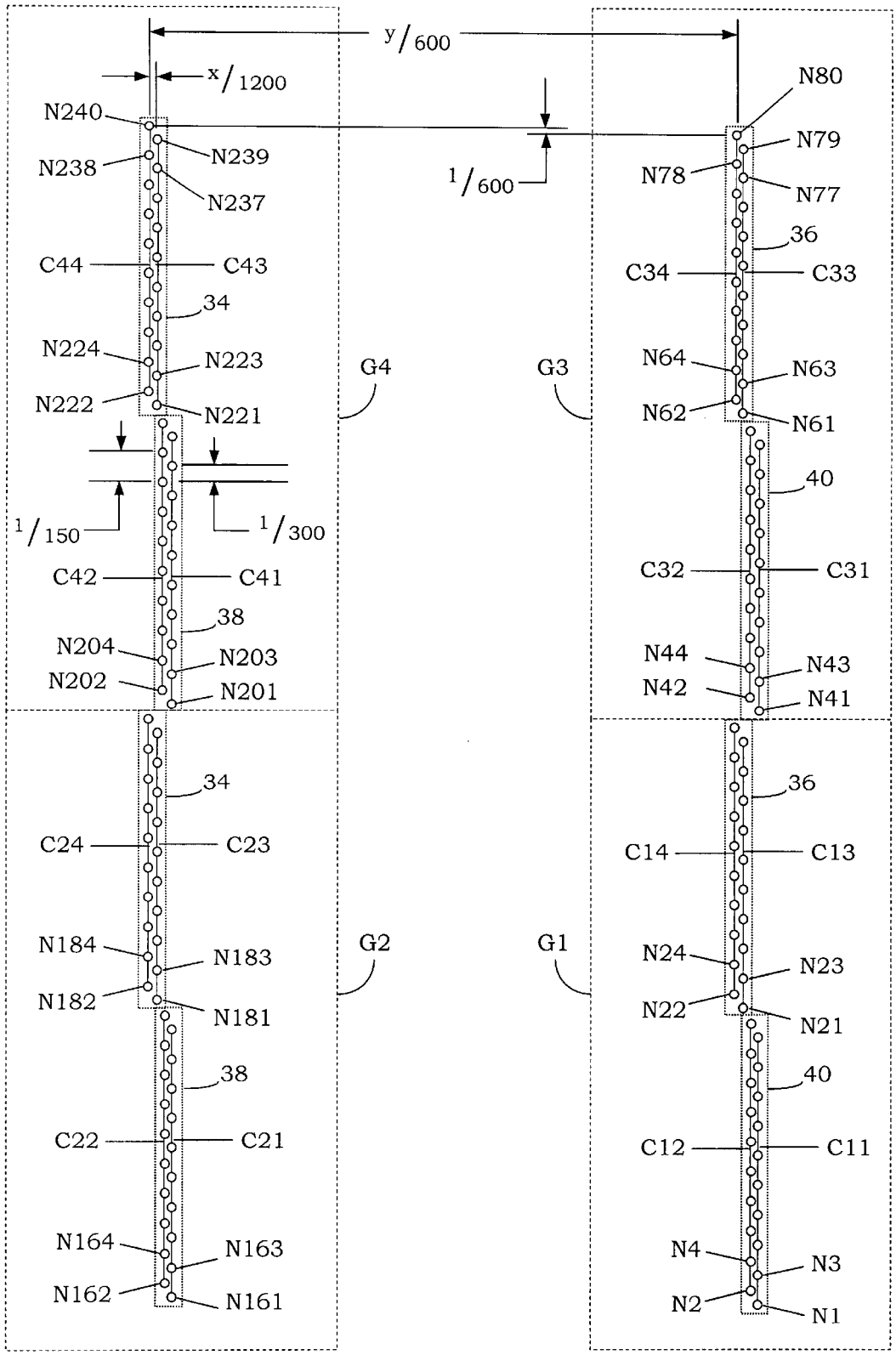
FIG. 3*c* depicts a more detailed view of the lower half of the first and second columnar arrays of ink jet nozzles according to the first embodiment of the invention.

FIGS. 3*b* and 3*c* depict the arrays 16*a* and 16*b* in greater detail, with FIG. 3*a* showing top half and FIG.3*b* showing the bottom half of the arrays 16*a* and 16*b*. For convenience of description, the arrays 16*a* and 16*b* are divided into subarray groupings. Array 16*a* is divided into power groups G2, G4, G6, and G8, and array 16*b* is divided into power groups G1, G3, G5, and G7. Each power group G1–G8 consists of four subarrays. For example, power group G1 consists of subarrays C11–C14, power group G2 consists of subarrays C21–C24, and so forth. The horizontal centers of horizontally-adjacent subarrays, such as C84 and C83 in FIG. 3*b*, are horizontally separated by a first horizontal spacing of x/1200 inch, where, in the preferred embodiment, x is one. Each subarray has n number of substantially collinear nozzles. In the preferred embodiment, n is ten. Vertically-adjacent nozzles within each subarray are preferably separated by 1/150 inch. Horizontally-adjacent subarrays are vertically offset from each other by 1/300 inch.

The upper horizontally-adjacent subarrays within each power group in the column 16*a*, such as subarray C83 and subarray C84, are also referred to herein as first upper subarray pairs 34. The upper horizontally-adjacent subarrays within each power group in the column 16*b*, such as subarray C73 and subarray C74, are also referred to herein as second upper subarray pairs 36. The lower horizontally-adjacent subarrays within each power group in the column 16*a*, such as subarray C81 and subarray C82, are also referred to herein as first lower subarray pairs 38. The lower horizontally-adjacent subarrays within each power group in the column 16*b*, such as subarray C71 and subarray C72, are also referred to herein as second lower subarray pairs 40.

The left subarray in each first upper subarray pair 34, such as subarray C84, is referred to herein as a first-upper-left subarray, and the right subarray in each first upper subarray pair 34, such as subarray C83, is referred to herein as a first-upper-right subarray. The left subarray in each second upper subarray pair 36, such as subarray C74, is referred to herein as a second-upper-left subarray, and the right subarray in each second upper subarray pair 36, such as subarray C73, is referred to herein as a second-upper-right subarray.

The left subarray in each first lower subarray pair 38, such as subarray C82, is referred to herein as a first-lower-left subarray, and the right subarray in each first lower subarray pair 38, such as subarray C81, is referred to herein as a first-lower-right subarray. The left subarray in each second lower subarray pair 40, such as subarray C72, is referred to herein as a second-lower-left subarray, and the right subarray in each second lower subarray pair 40, such as subarray C71, is referred to herein as a second-lower-right subarray.

Figure 3D:
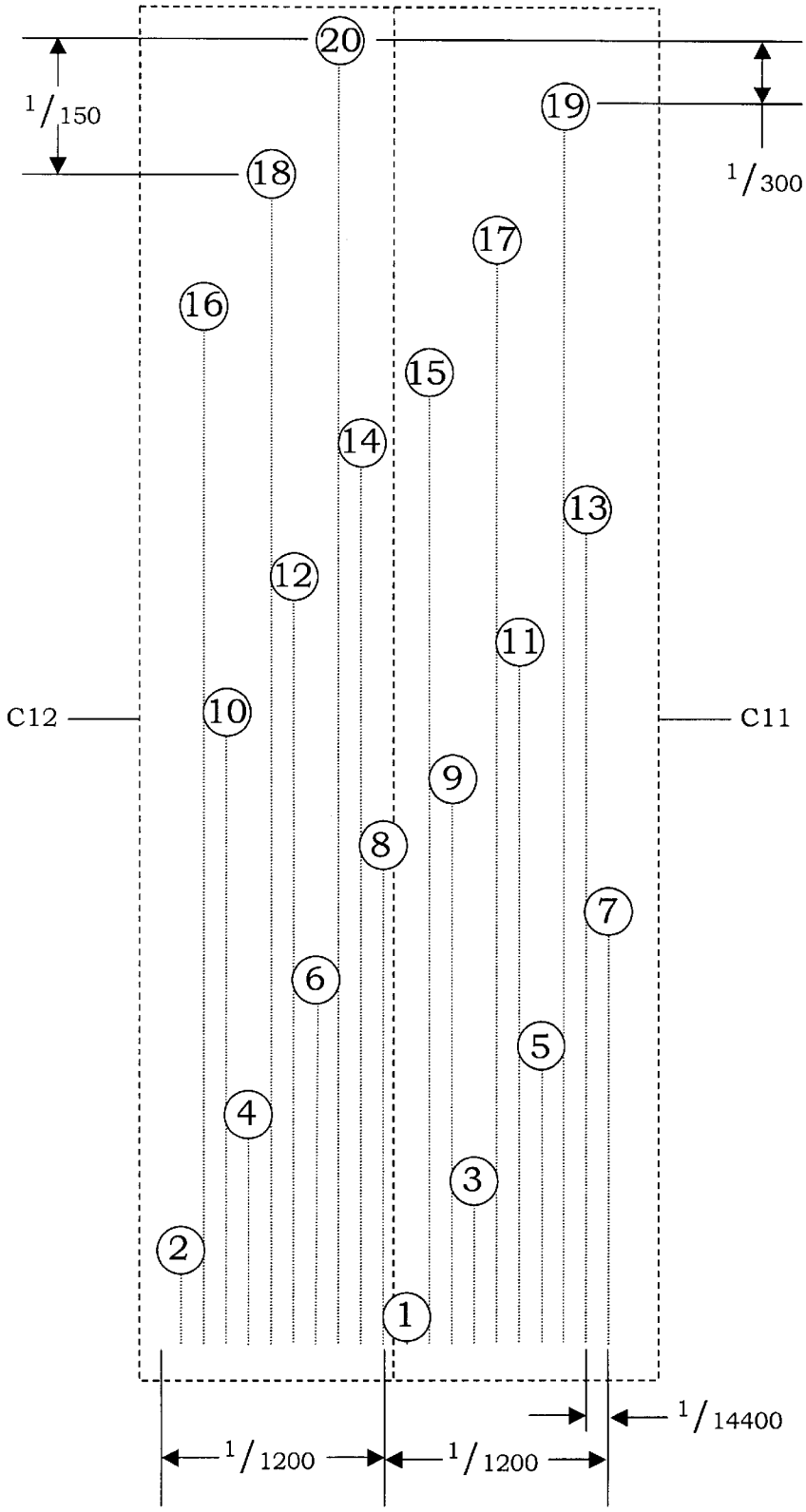
FIG. 3*d* depicts an arrangement of ink jet nozzles within a subarray pair according to a preferred embodiment of the invention.

In a preferred embodiment of the invention, the nozzles within each subarray are not exactly collinear, but are horizontally offset relative to each other, such as shown in FIG. 3*d*. As discussed in more detail below, nozzles within a subarray do not fire simultaneously as the print head 12 translates across the print medium 6. Thus, the horizontal offset as illustrated in FIG. 3*d* aligns each nozzle in the same vertical line on the print medium 6 at the instant in time when the nozzle fires. This provides for the correct vertical alignment of printed dots. FIG. 3*d* illustrates the preferred nozzle spacing for the subarray pair C11–C12. Preferably, the other subarray pairs have the same relative nozzle spacings as that shown in FIG. 3*d*.

With reference to FIG. 1, the printer 2 includes a print head scanning mechanism 18 for scanning the print head 12 across the print medium 6 in a scanning direction as indicated by the arrow 20. Preferably, the print head scanning mechanism 20 consists of a carriage which slides horizontally on one or more rails, a belt attached to the carriage, and a motor that engages the belt to cause the carriage to move along the rails. The motor is driven in response to the scan commands generated by the printer controller 8.

As shown in FIG. 1, the printer 2 also includes a print medium advance mechanism 22. Based on print medium advance commands generated by the controller 8, the print medium advance mechanism 22 causes the print medium 6 to advance in a paper advance direction, as indicated by the arrow 24, between consecutive scans of the print head 12. Thus, the image 4 is formed on the print medium 6 by printing multiple adjacent swaths as the print medium 6 is advanced in the advance direction between swaths. In a preferred embodiment of the invention, the print medium advance mechanism 22 is a stepper motor rotating a platen which is in contact with the print medium 16.

As mentioned above, the heating elements in the print head 12 are activated by print signals from the printer controller 8. In a first embodiment of the invention, as shown in FIG. 1, the print signals consist of four quad signals, eight power signals, and ten address signals which are transferred to the print head 12 over four quad lines Q1–Q4, eight power lines P1–P8, and an address bus A, respectively. The address bus of this embodiment includes ten address lines A1–A10. As described in more detail below, this combination of signal lines provides for addressing 320 heating elements (4×8×10) corresponding to the 320 nozzles.

It will be appreciated that the number of address lines that connect the print head 12 to the printer controller 8 could be further reduced by including binary decoder circuitry on the print head 12. For example, the ten address signals of the first embodiment could be encoded in the printer controller 8 on four lines, and then decoded in the print head 12 onto the ten address lines A1–A10. Also, twenty address signals of a second embodiment could be encoded in the printer controller 8 on five lines, and then decoded in the print head 12 onto twenty address lines.

Figure 4A:
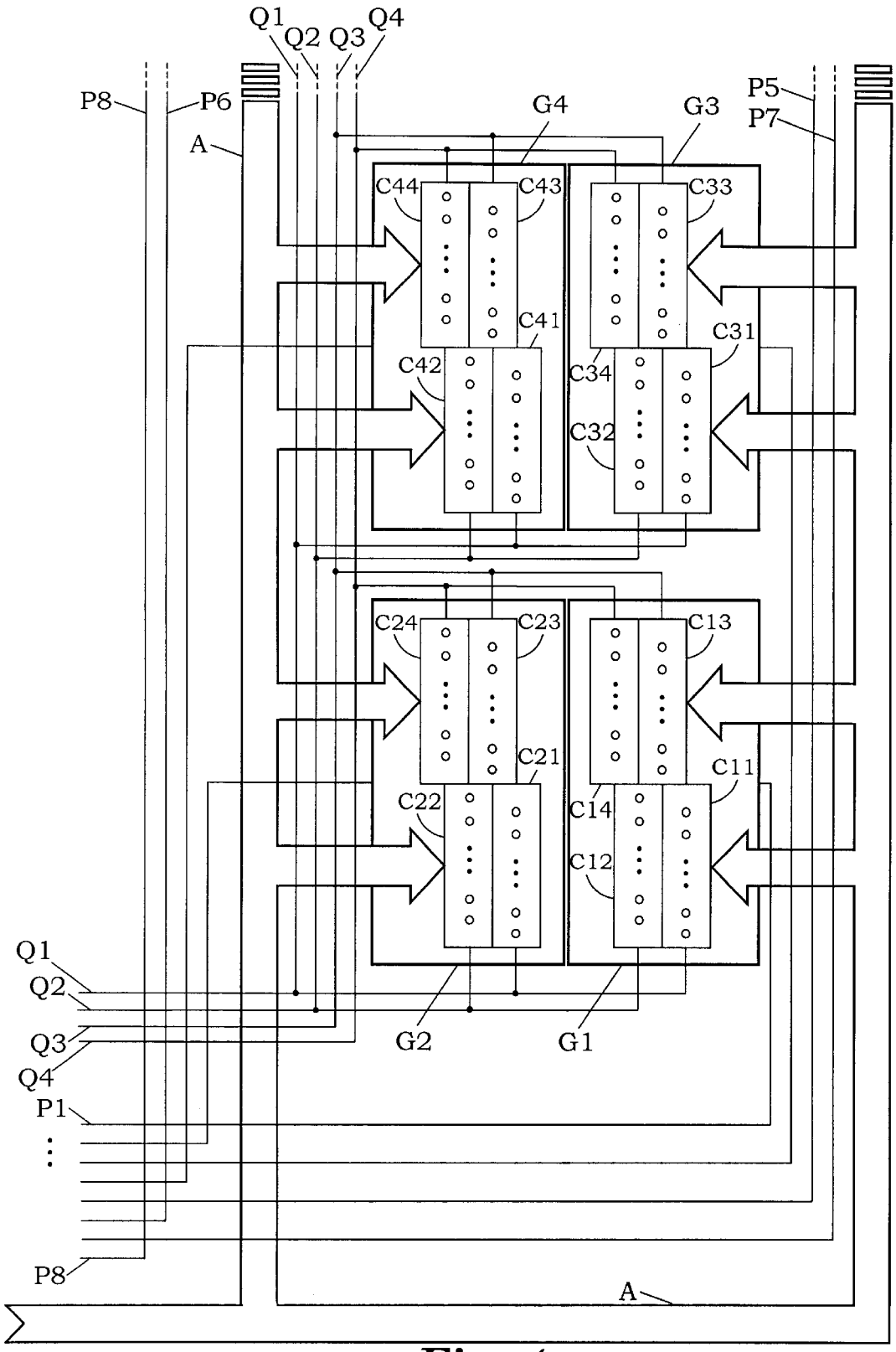
FIG. 4*a* is a functional schematic diagram showing a nozzle addressing scheme for the lower half of the first and second columnar arrays of ink jet nozzles according to the first embodiment of the invention.
Figure 4B:
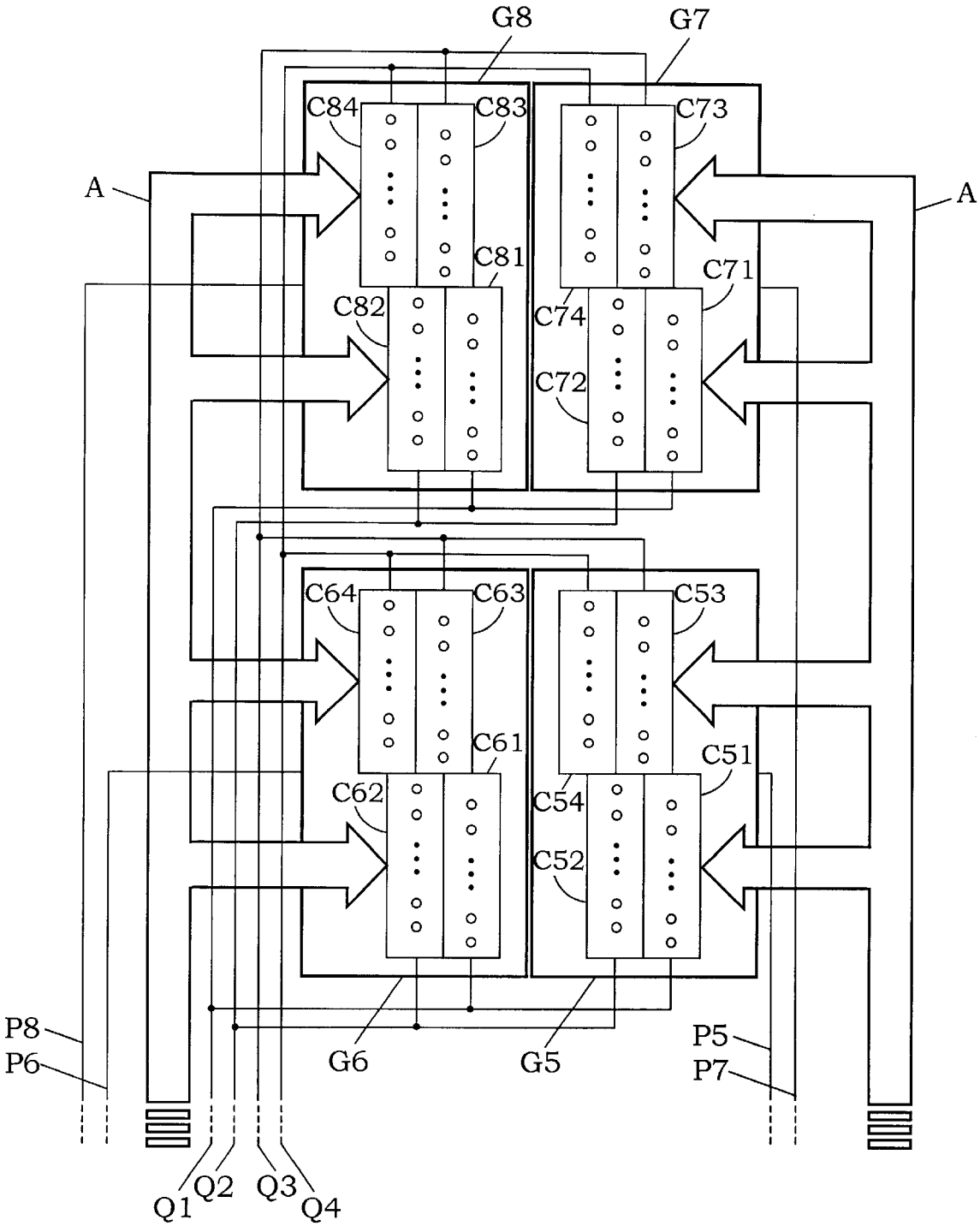
FIG. 4*b* is a functional schematic diagram showing a nozzle addressing scheme for the upper half of the first and second columnar arrays of ink jet nozzles according to the first embodiment of the invention.

Referring now to FIGS. 4*a* and 4*b*, the addressing scheme of the first embodiment of the invention is described. FIG. 4*a* depicts the connection of quad, power, and address lines to power groups G1–G4,while FIG. 4*b*, which is a continuation of FIG. 4*a*, depicts the connection of quad, power, and address lines to power groups G5–G8. Each power group of subarrays is connected to a corresponding one of the power lines P1–P8. For example, power line P1 is connected to power group G1, power line P2 is connected to power group G2, and so forth. Each quad line Q1–Q4 is connected to one of the four subarrays within each of the power groups G1–G8. For example, quad line Q1 is connected to subarrays C11, C21, C31, C41, C51, C61, C71, and C81, quad line Q2 is connected to subarrays C12, C22, C32, C42 C52, C62, C72, and C82, and so forth. The ten address lines A1–A10 in the address bus A provide for individually addressing each of the ten nozzles in each subarray.

Tables I, II, III, and IV below correlate nozzle numbers to quad, power, and address lines.

TABLE I

| | Power | Q1 | | | | | | | | | |
|---|---|---|---|---|---|---|---|---|---|---|---|
| Subarray | Line | A1 | A2 | A3 | A4 | A5 | A6 | A7 | A8 | A9 | A10 |
| C11 | P1 | 1 | 15 | 9 | 3 | 17 | 11 | 5 | 19 | 13 | 7 |
| C21 | P2 | 161 | 175 | 169 | 163 | 177 | 171 | 165 | 179 | 173 | 167 |
| C31 | P3 | 41 | 55 | 49 | 43 | 57 | 51 | 45 | 59 | 53 | 47 |
| C41 | P4 | 201 | 215 | 209 | 203 | 217 | 211 | 205 | 219 | 213 | 207 |
| C51 | P5 | 81 | 95 | 89 | 83 | 97 | 91 | 85 | 99 | 93 | 87 |
| C61 | P6 | 241 | 255 | 249 | 243 | 257 | 251 | 245 | 259 | 253 | 247 |
| C71 | P7 | 121 | 135 | 129 | 123 | 137 | 131 | 125 | 139 | 133 | 127 |
| C81 | P8 | 281 | 295 | 289 | 283 | 297 | 291 | 285 | 299 | 293 | 287 |

TABLE II

| | Power | Q2 | | | | | | | | | |
|---|---|---|---|---|---|---|---|---|---|---|---|
| Subarray | Line | A1 | A2 | A3 | A4 | A5 | A6 | A7 | A8 | A9 | A10 |
| C12 | P1 | 2 | 16 | 10 | 4 | 18 | 12 | 6 | 20 | 14 | 8 |
| C22 | P2 | 162 | 176 | 170 | 164 | 178 | 172 | 166 | 180 | 174 | 168 |
| C32 | P3 | 42 | 56 | 50 | 44 | 58 | 52 | 46 | 60 | 54 | 48 |
| C42 | P4 | 202 | 216 | 210 | 204 | 218 | 212 | 206 | 220 | 214 | 208 |
| C52 | P5 | 82 | 96 | 90 | 84 | 98 | 92 | 86 | 100 | 94 | 88 |
| C62 | P6 | 242 | 256 | 250 | 244 | 258 | 252 | 246 | 260 | 254 | 248 |
| C72 | P7 | 122 | 136 | 130 | 124 | 138 | 132 | 126 | 140 | 134 | 128 |
| C82 | P8 | 282 | 296 | 290 | 284 | 298 | 292 | 286 | 300 | 294 | 288 |

TABLE III

| | Power | Q3 | | | | | | | | | |
|---|---|---|---|---|---|---|---|---|---|---|---|
| Subarray | Line | A1 | A2 | A3 | A4 | A5 | A6 | A7 | A8 | A9 | A10 |
| C13 | P1 | 21 | 35 | 29 | 23 | 37 | 31 | 25 | 39 | 33 | 27 |
| C23 | P2 | 181 | 195 | 189 | 183 | 197 | 191 | 185 | 199 | 193 | 187 |
| C33 | P3 | 61 | 75 | 69 | 63 | 77 | 71 | 65 | 79 | 73 | 67 |
| C43 | P4 | 221 | 235 | 229 | 223 | 237 | 231 | 225 | 239 | 233 | 227 |
| C53 | P5 | 101 | 115 | 109 | 103 | 117 | 111 | 105 | 119 | 113 | 107 |
| C63 | P6 | 261 | 275 | 269 | 263 | 277 | 271 | 265 | 279 | 273 | 267 |
| C73 | P7 | 141 | 155 | 149 | 143 | 157 | 151 | 145 | 159 | 153 | 147 |
| C83 | P8 | 301 | 315 | 309 | 303 | 317 | 311 | 305 | 319 | 313 | 307 |

TABLE IV

| | Power | Q4 | | | | | | | | | |
|---|---|---|---|---|---|---|---|---|---|---|---|
| Subarray | Line | A1 | A2 | A3 | A4 | A5 | A6 | A7 | A8 | A9 | A10 |
| C14 | P1 | 22 | 36 | 30 | 24 | 38 | 32 | 26 | 40 | 34 | 28 |
| C24 | P2 | 182 | 196 | 190 | 184 | 198 | 192 | 186 | 200 | 194 | 188 |
| C34 | P3 | 62 | 76 | 70 | 64 | 78 | 72 | 66 | 80 | 74 | 68 |
| C44 | P4 | 222 | 236 | 230 | 224 | 238 | 232 | 226 | 240 | 234 | 228 |
| C54 | P5 | 102 | 116 | 110 | 104 | 118 | 112 | 106 | 120 | 114 | 108 |
| C64 | P6 | 262 | 276 | 270 | 264 | 278 | 272 | 266 | 280 | 274 | 268 |
| C74 | P7 | 142 | 156 | 150 | 144 | 158 | 152 | 146 | 160 | 154 | 148 |
| C84 | P8 | 302 | 316 | 310 | 304 | 318 | 312 | 306 | 320 | 314 | 308 |

According to the first embodiment of the invention, a particular heating element is activated and, thus, an ink droplet is ejected from the nozzle corresponding to the activated heating element, when the corresponding power, quad, and address signals for that nozzle are simultaneously on or "high". The invention incorporates driver and switching devices to activate the heating elements based on the power, quad, and address signals.

Figure 5:
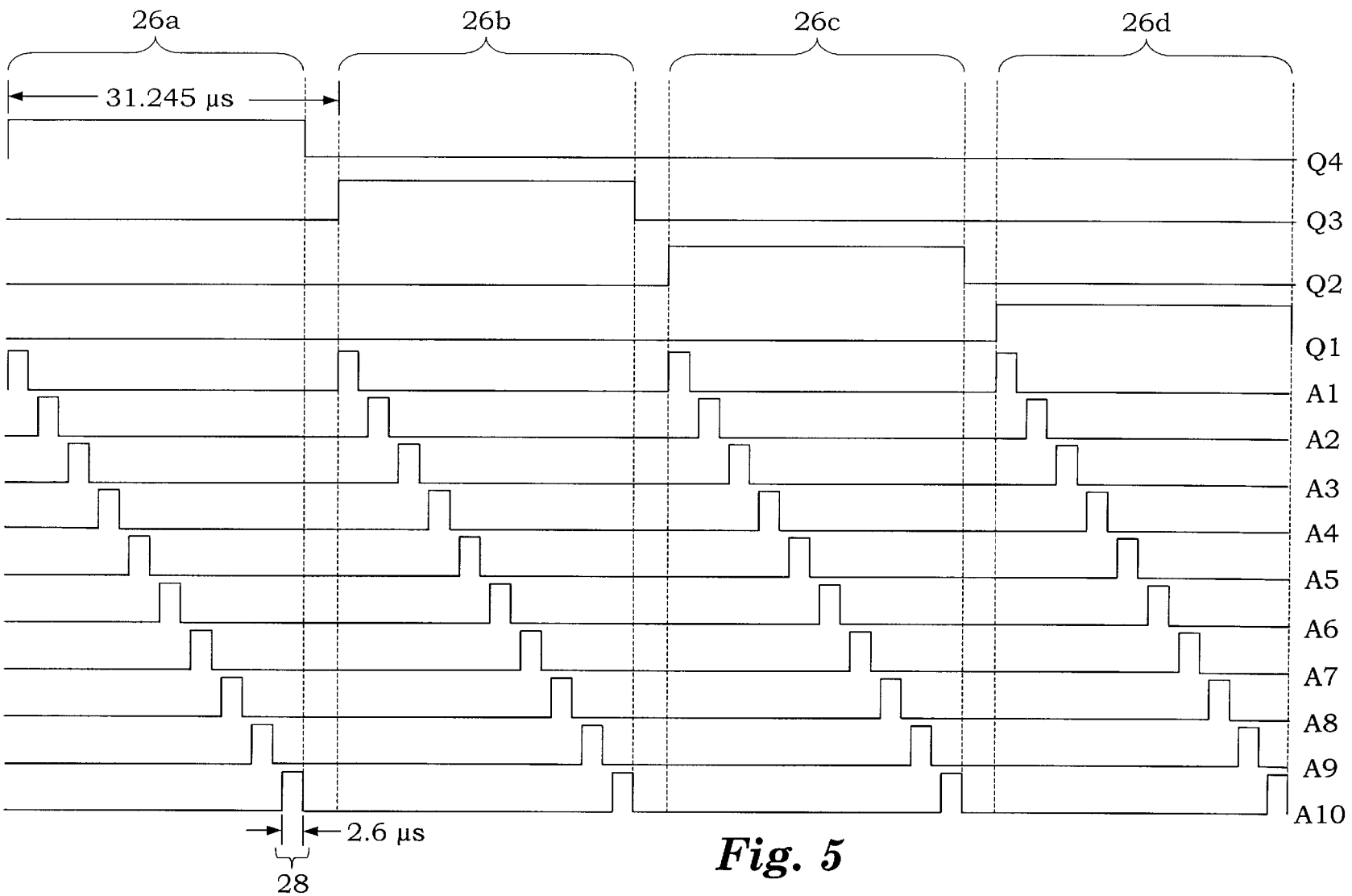
FIG. 5 is a signal timing diagram for a nozzle addressing scheme according to the first embodiment of the invention.

FIG. 5 is a timing diagram depicting the preferred signal timing scheme of the invention. As shown in FIG. 5, the quad signals on quad lines Q1–Q4 are high during sequential quad windows 26*a*–26*d*. Preferably, each quad window 26*a*–26*d* endures for approximately 31.245 $\mu$s. During each quad window 26*a*–26*d*, each of the address lines A1–A10 go high within sequential address windows 28 of approximately 2.6 $\mu$s duration. During any address window 28, the printer controller 8 may drive any combination of the power lines P1–P8 high, as determined by the image data.

The signal transitions shown in FIG. 5 occur as the print head scanning mechanism 18 scans the print head 12 across the print medium 6 from right to left. This assumes that the image 4 is printed upside-down (as shown in FIG. 1) with the print head 12 shooting downward at the print medium 6. As the print head 12 scans from left to right, the order of the quad window transitions is reversed: first Q1 is high, then Q2, Q3, and Q4. Also, as the print head 12 scans from left to right, the order of the address lines going high is reversed. Thus, as the print head 12 travels from left to right, address line A10 goes high first, then A9, and so forth. In the preferred embodiment of the invention, the scan speed of the print head 12 is approximately 26.67 inch/second. Thus, during one address window 28, the print head 12 travels approximately $6.93\times10^{-5}$ inch in the scan direction. During one quad window, the print head 12 travels approximately $8.33\times10^{-4}$ (1/1200) inch.

Figure 6A:
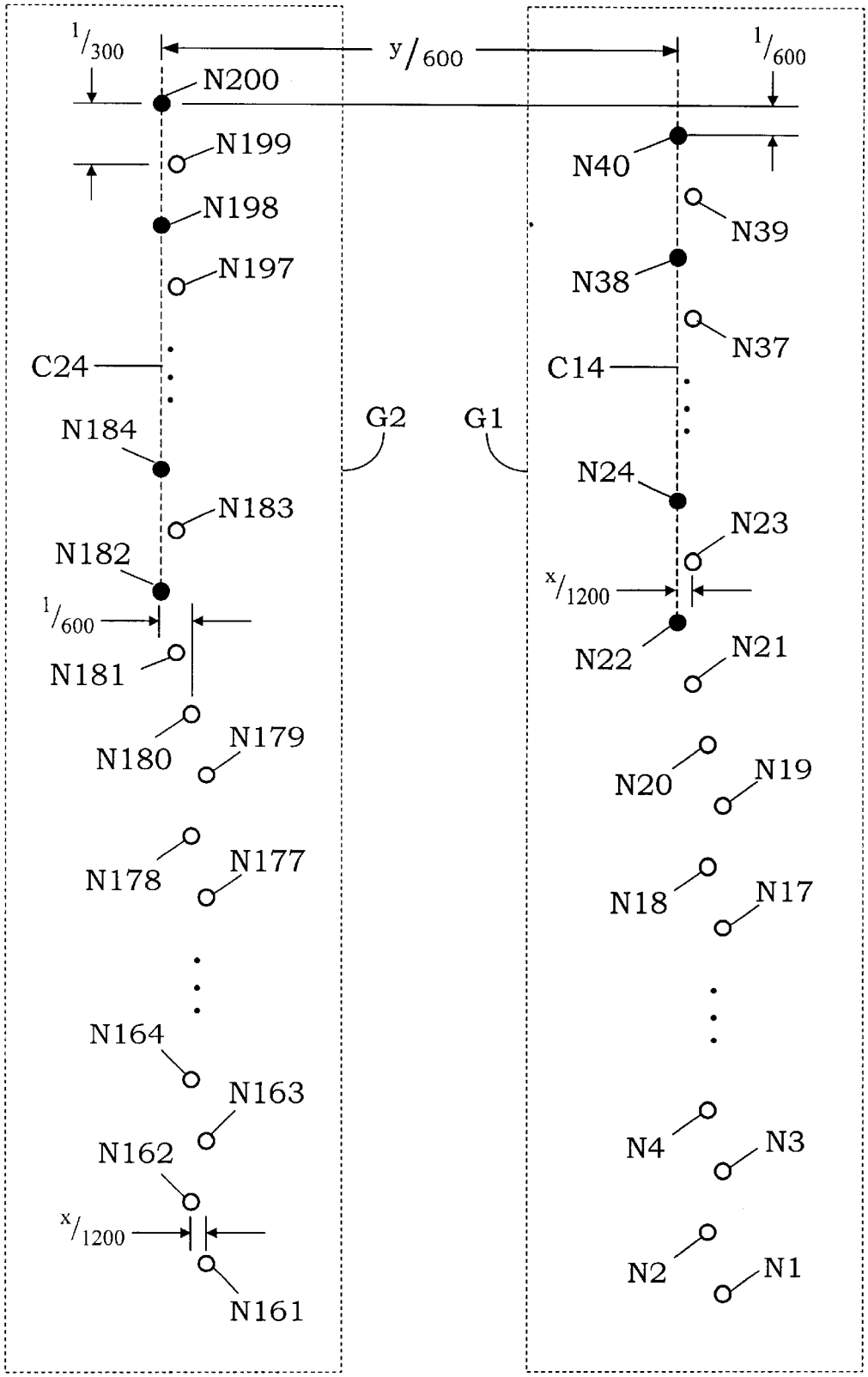
FIGS. 6*a*–6*d* depict a portion of the nozzles on the print head and indicate those nozzles that fire during sequential periods of time according to the first embodiment of the invention.

FIGS. 6*a*–6*d* depict the spatial arrangement of the nozzles within the power groups G1 and G2 and the sequence of nozzle firings which occur to print a checkerboard pattern of dots. In FIG. 6*a*, the blackened circles represent the nozzles in power groups G1 and G2 that can be fired during the quad window 26*a* while the quad line Q4 is high. The even-numbered nozzles N22–N40 in subarray C14 of the power group G1 are fired when the controller 8 sets the power signal high on power line P1 during each of the ten address windows 28. Similarly, the even-numbered nozzles N182–N200 in subarray C24 of the power group G2 are fired when the controller 8 sets the power signal high on power line P2 during each of the ten address windows 28.

Figure 7A:
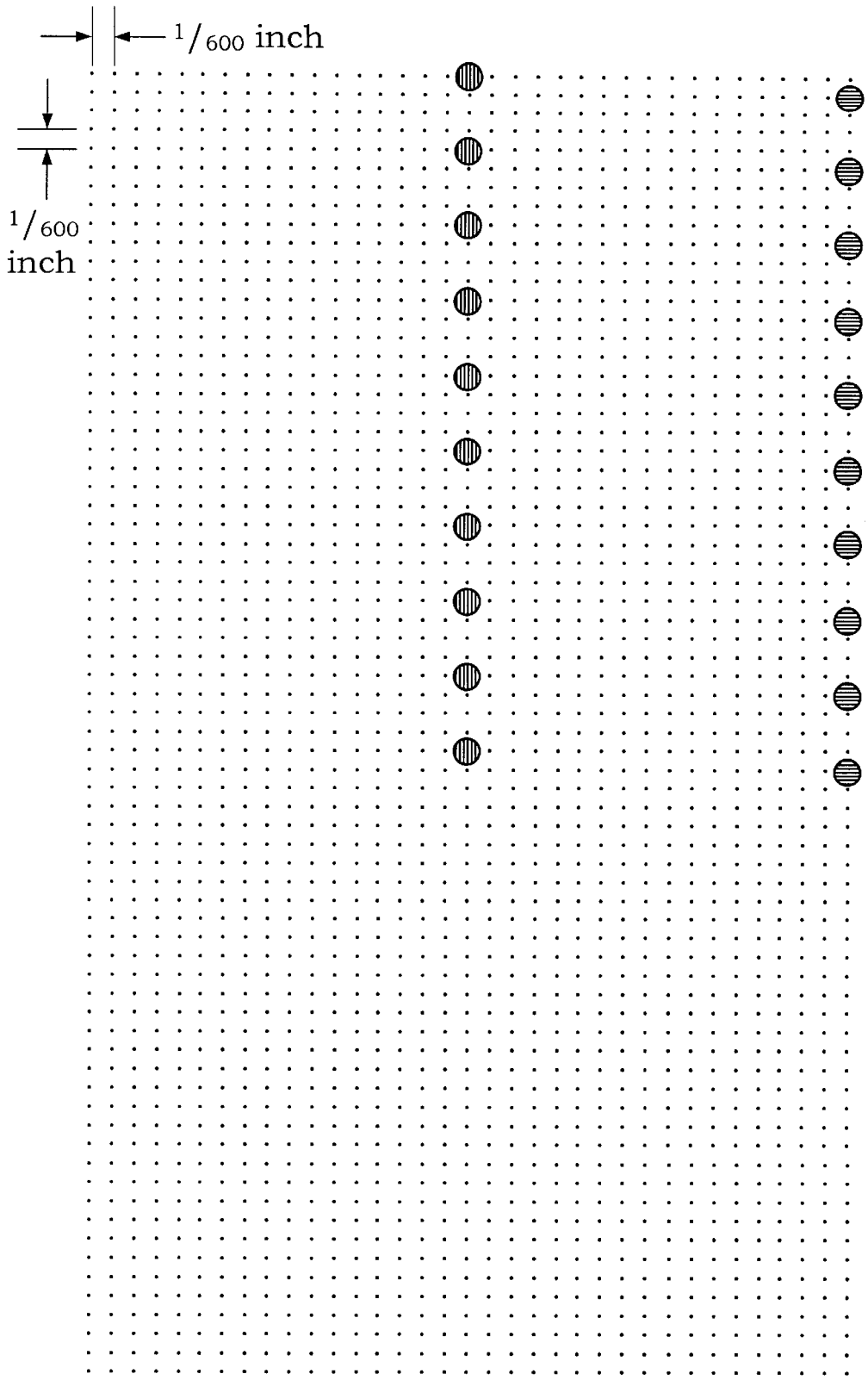
FIGS. 7*a*–7*d* depict patterns of dots that print on a print medium during sequential periods of time according to the first embodiment of the invention.

The resulting dot pattern at the completion of quad window 26*a* is shown in FIG. 7*a*. The circles in the first, or left, vertical column with the vertical hatching represent dots printed by the even-numbered nozzles N182–N200, and the circles in the second, or right, vertical column with the horizontal hatching represent dots printed by the even-numbered nozzles N22–N40. Each of the small dots in FIG. 7*a* represents a grid location in a 600 dpi grid.

Figure 6B:
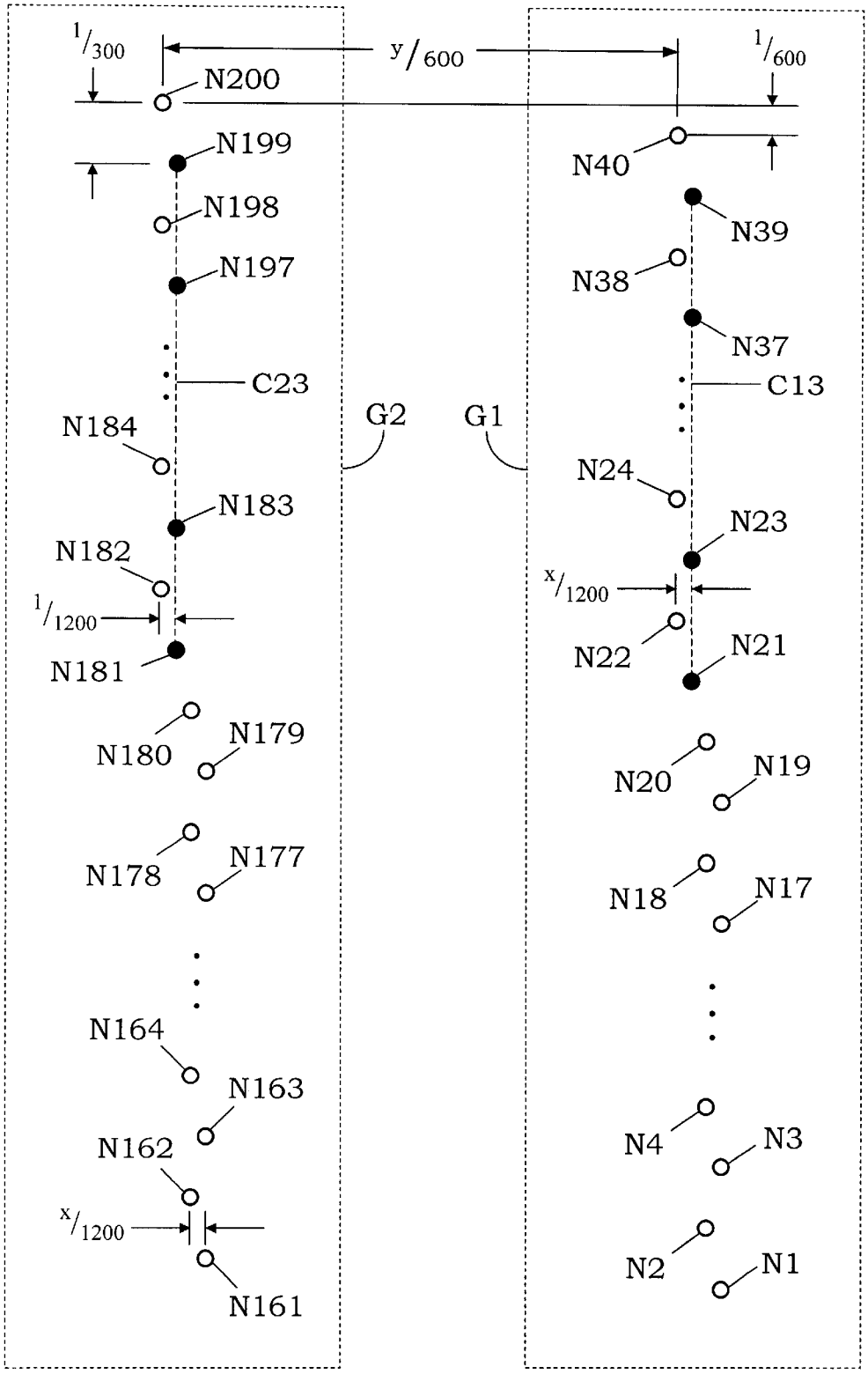

As shown in FIG. 6*b*, the subarrays C23 and C13 are offset to the right of the subarrays C24 and C14, respectively, by 1/1200 inch in the nozzle plate 14. Since the print head 12 is continuously moving during the quad window 26*a*, the print head 12 has traveled 1/1200 inch to the left by the beginning of the quad window 26*b*. Thus, at the beginning of the quad window 26*b*, the subarrays C23 and C13 are positioned over the same scan location on the print medium 6 as were the subarrays C24 and C14 at the beginning of the quad window 26*a*.

FIG. 6*b* depicts the nozzles within the power groups G1 and G2 that can be fired during the quad window 26*b* to continue the printing of the checkerboard pattern. During the quad window 26*b*, while quad line Q3 is high, the controller 8 sets the power signals high on power lines P1 and P2 during each of the ten address windows 28, thus firing the odd-numbered nozzles N21–N39 in subarray C13 of the power group G1 and the odd-numbered nozzles N181–N199 in subarray C23 of the power group G2. The nozzles of subarrays C13 and C23 that are activated during the quad window 26*b* are represented in FIG. 6*b* as the blackened circles.

Figure 7B:
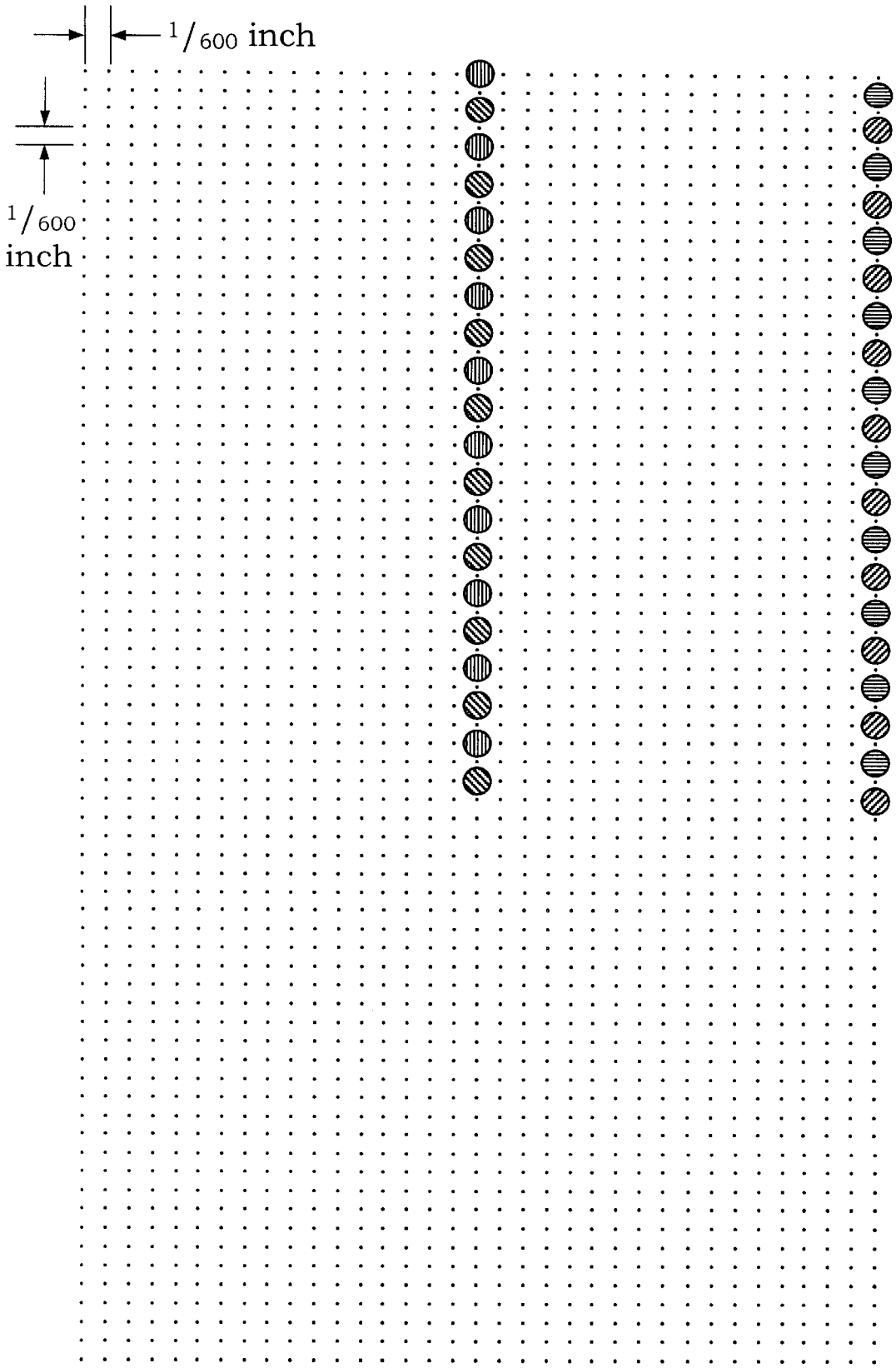

The resulting dot pattern at the completion of quad window 26*b* is shown in FIG. 7*b*. The circles filled with the diagonal hatching (interlaced with the circles filled with the vertical hatching) represent dots printed by the odd-numbered nozzles N181–N199, and the circles with the diagonal hatching (interlaced with the circles filled with the horizontal hatching) represent dots printed by the odd-numbered nozzles N21–N39.

Figure 6C:
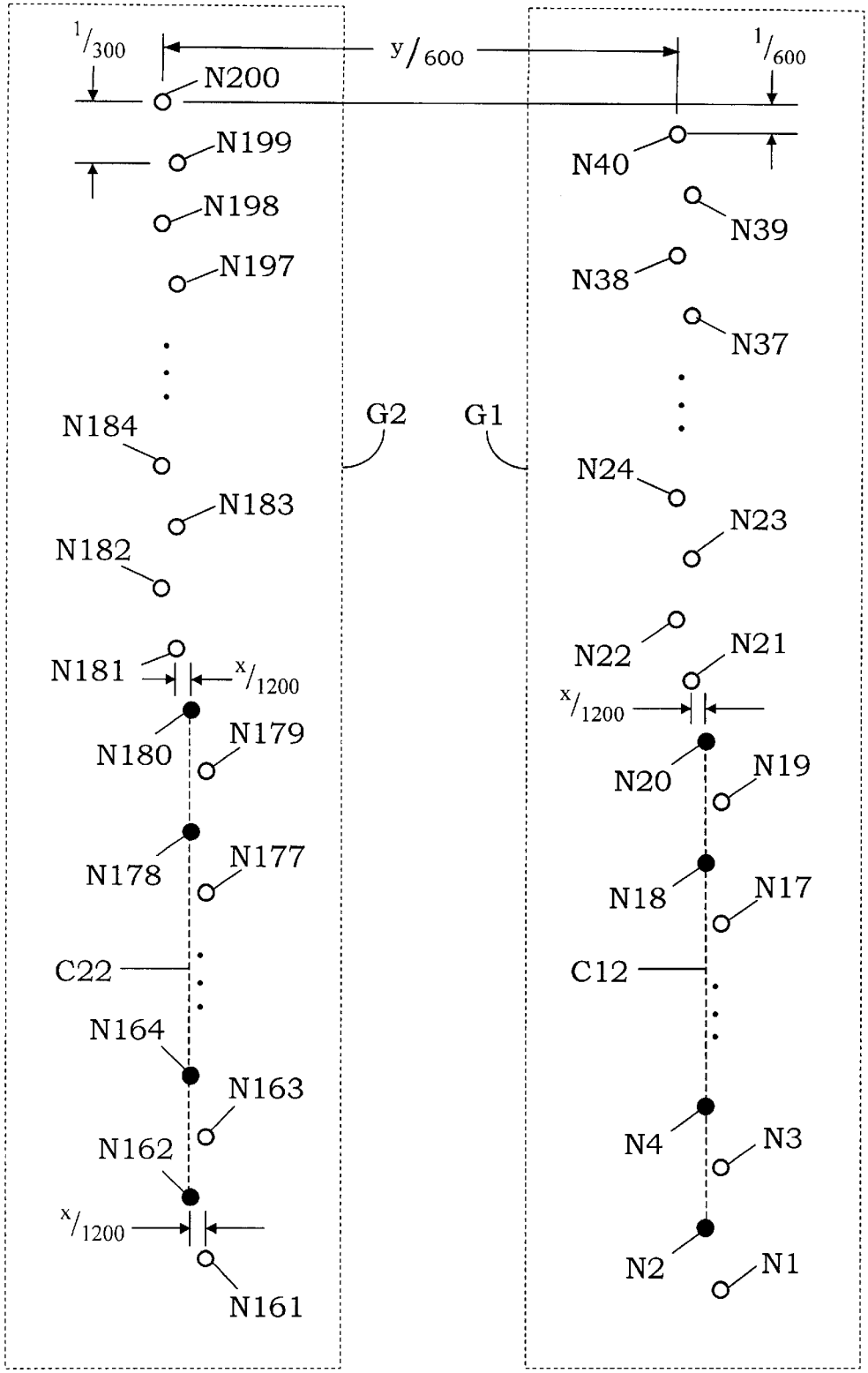

As shown in FIG. 6*c*, the subarrays C22 and C12 are offset to the right of the subarrays C23 and C13, respectively, by 1/1200 inch. As the print head 12 moves during the quad window 26*b*, the print head 12 travels 1/1200 inch to the left. Thus, at the beginning of the quad window 26*c*, the subarrays C22 and C12 are positioned over the same scan location on the print medium 6 as were the subarrays C23 and C13 at the beginning of the quad window 26*b*.

FIG. 6*c* depicts the nozzles within the power groups G1 and G2 that can be fired during the quad window 26*c* to continue the printing of the checkerboard pattern. During the quad window 26*c*, while quad line Q2 is high, the controller 8 sets the power signals high on power lines P1 and P2 during each of the ten address windows 28, thus firing the even-numbered nozzles N2–N20 in subarray C12 of the power group G1 and the even-numbered nozzles N162–N180 in subarray C22 of the power group G2. The nozzles of subarrays C12 and C22 that are activated during the quad window 26*c* are represented in FIG. 6*c* as the blackened circles.

Figure 7C:
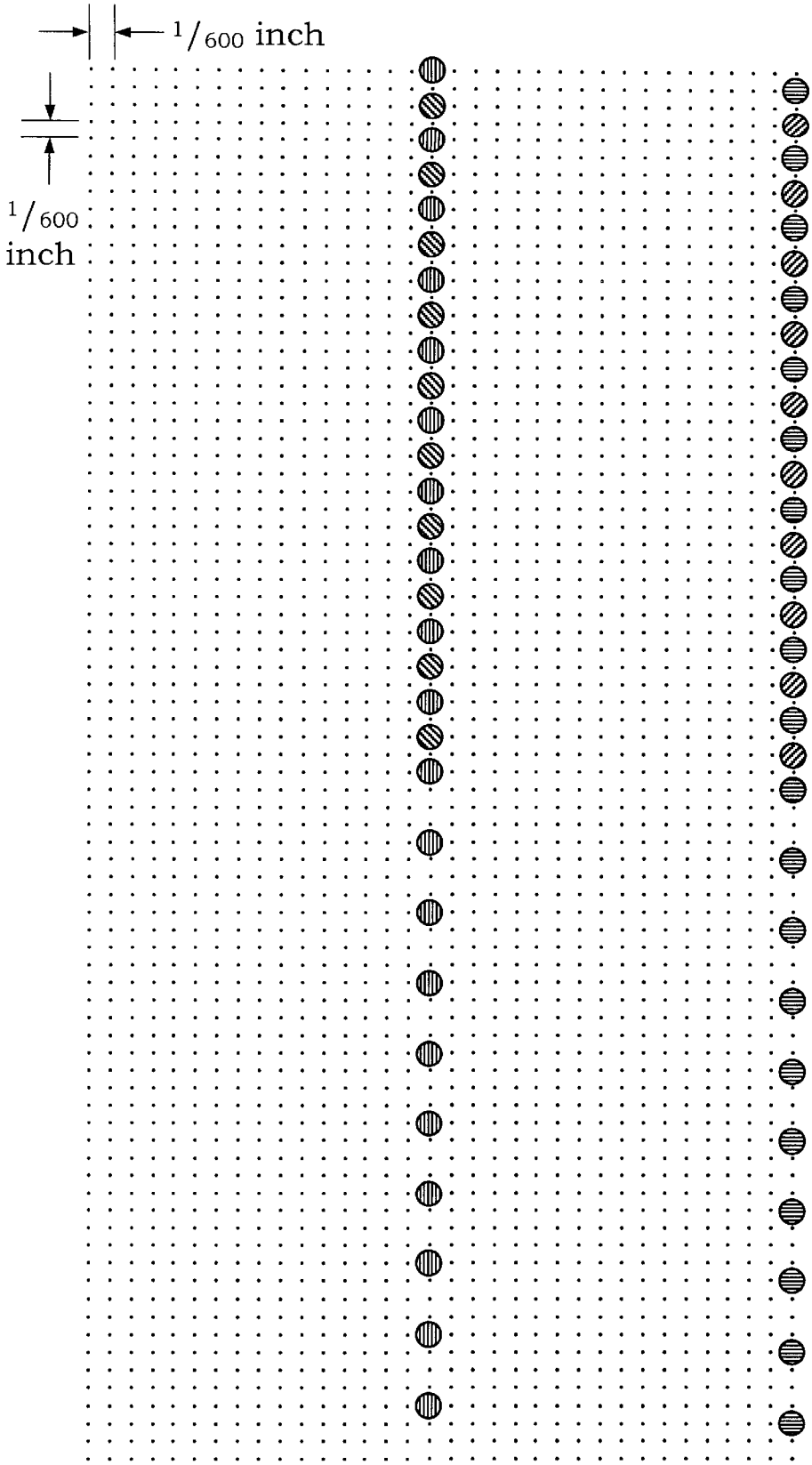

The resulting dot pattern at the completion of quad window 26*c* is shown in FIG. 7*c*. The circles in the bottom half of the figure with the vertical hatching represent dots printed by the even-numbered nozzles N162–N180, and the circles in the bottom half of the figure with the horizontal hatching represent dots printed by the even-numbered nozzles N2–N20.

Figure 6D:
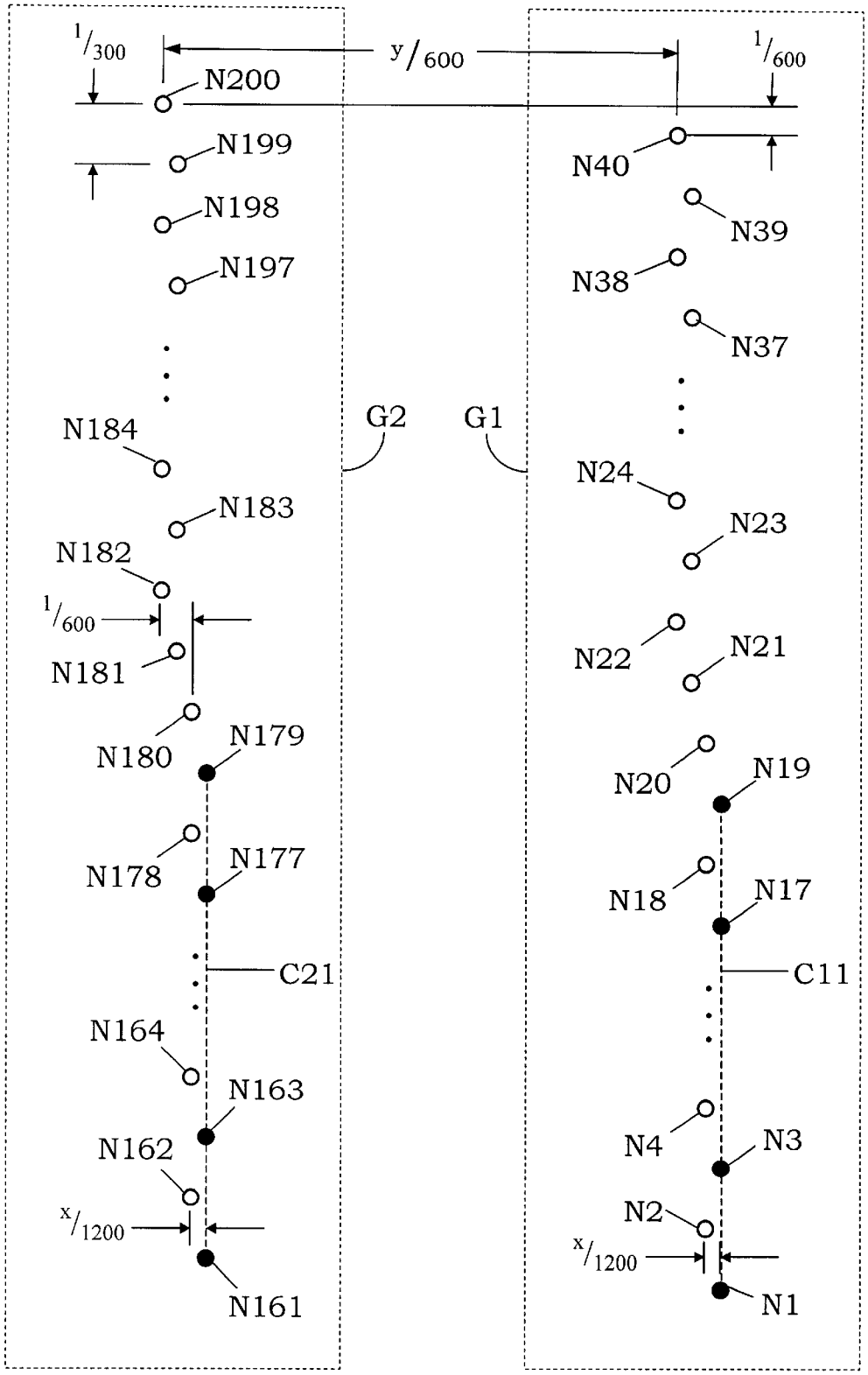

As shown in FIG. 6*d*, the subarrays C21 and C11 are offset to the right of the subarrays C22 and C12, respectively, by 1/120 inch. As the print head 12 moves during the quad window 26*c*, the print head 12 travels 1/1200 inch to the left. Thus, at the beginning of the quad window 26*d*, the subarrays C21 and C11 are positioned over the same scan location on the print medium 6 as were the subarrays C22 and C12 at the beginning of the quad window 26*c*.

FIG. 6*d* depicts the nozzles within the power groups G1 and G2 that can be tired during the quad window 26*d* to continue the printing of the checkerboard pattern. During the quad window 26*d*, while quad line Q1 is high, the controller 8 again sets the power signals high on power lines P1 and P2 during each of the ten address windows 28, thus firing the odd-numbered nozzles NI–N19 in subarray C11 of the power group G1 and the odd-numbered nozzles N161–N179 in subarray C21 of the power group G2. The nozzles of subarrays C11 and C21 that are activated during the quad window 26*d* are represented in FIG. 6*d* as the blackened circles.

Figure 7D:
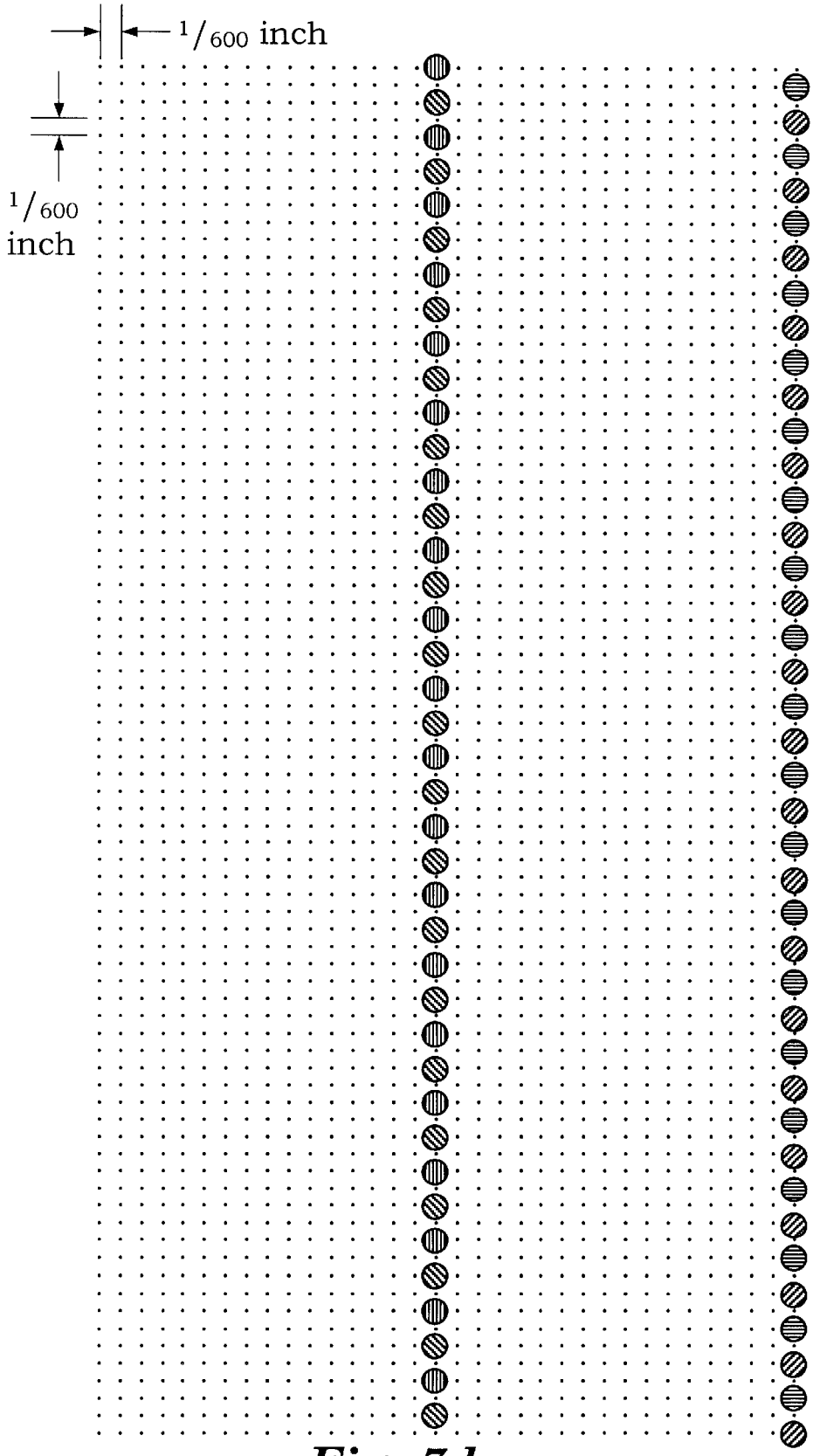

The resulting dot pattern at the completion of quad window 26*d* is shown in FIG. 7*d*. The circles in the bottom half of the figure filled with the diagonal hatching (interlaced with the circles filled with the vertical hatching) represent dots printed by the odd-numbered nozzles N161–N179, and the circles in the bottom half of the figure with the diagonal hatching (interlaced with the circles filled with the horizontal hatching) represent dots printed by the odd-numbered nozzles N1–N19.

Figure 8:
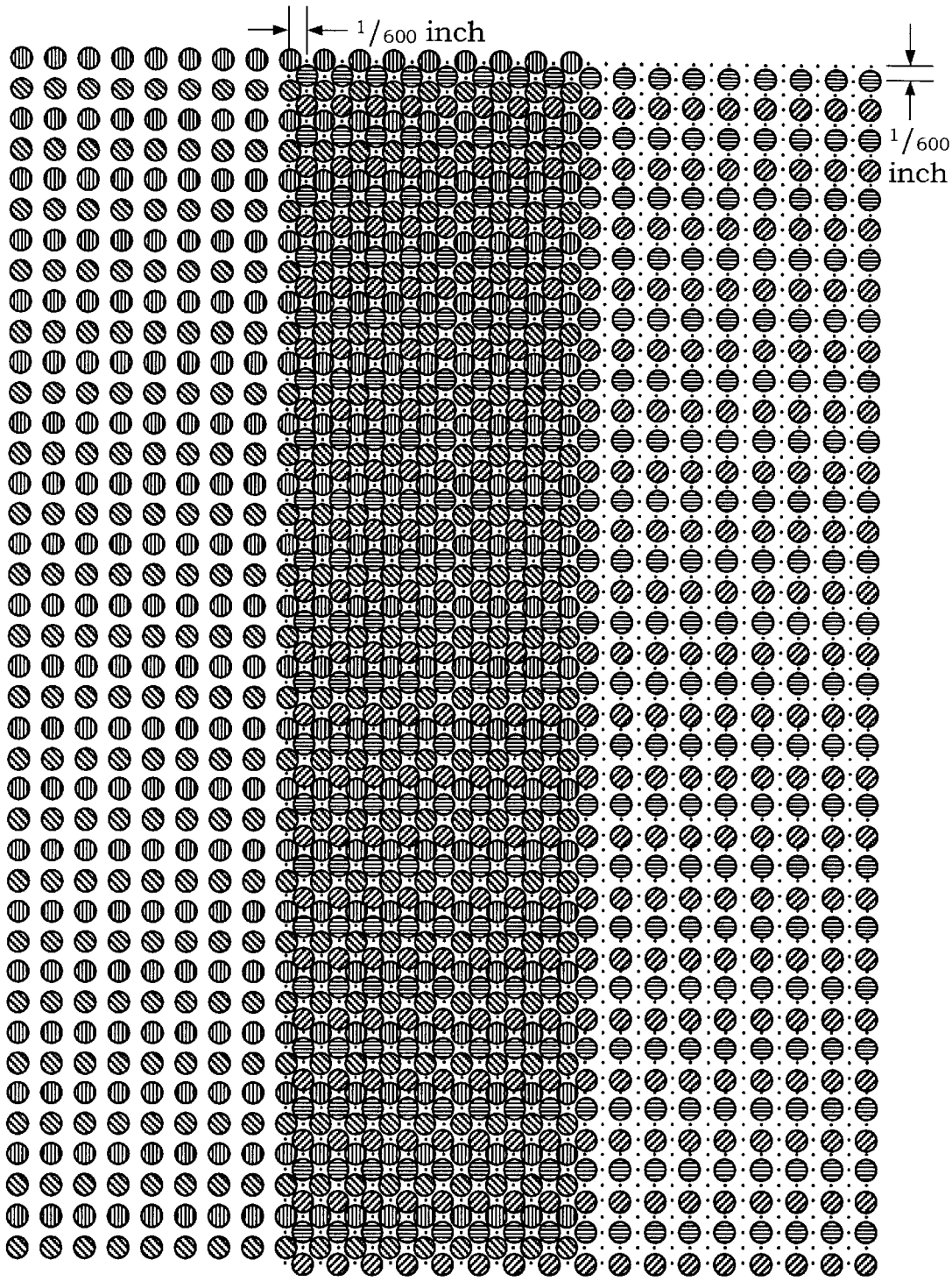
FIG. 8 depicts a checkerboard pattern of dots printed according to a preferred embodiment of the invention.

As the print head 12 continues to scan across the print medium 6, the process described above repeats. By the beginning of the next quad window 26*a*, the subarrays C24 and C14 are positioned 1/300 inch to left of where they were at the beginning of the previous quad window 26*a*. After completing seventeen cycles of the process described above, the checkerboard pattern of dots as depicted in FIG. 8 has been printed by the nozzles in power groups G1 and G2 in the bottom one-fourth of the printed swath. Note that, since the nozzles of subarrays C11, C13, C21, and C23 are offset 1/600 inch below the corresponding nozzles of subarrays C12, C23, C22, and C24, respectively, the 600 dpi checkerboard pattern is completely filled in during a single pass of the print head 12 across the print medium 6 without any need for a movement of the print medium 6.

In the first embodiment of the invention, the spatial arrangement of nozzles in the other power groups G3–G8 is identical to that shown in FIGS. 6*a*–6*d*. Thus, while the nozzles of the power groups G1 and G2 are printing the checkerboard pattern of dots according to the process described above in the bottom one-fourth of the swath, the nozzles of the power groups G3–G4, G5–G6, and G7–G8 are printing the same pattern in the upper three-fourths of the swath.

Figure 9:
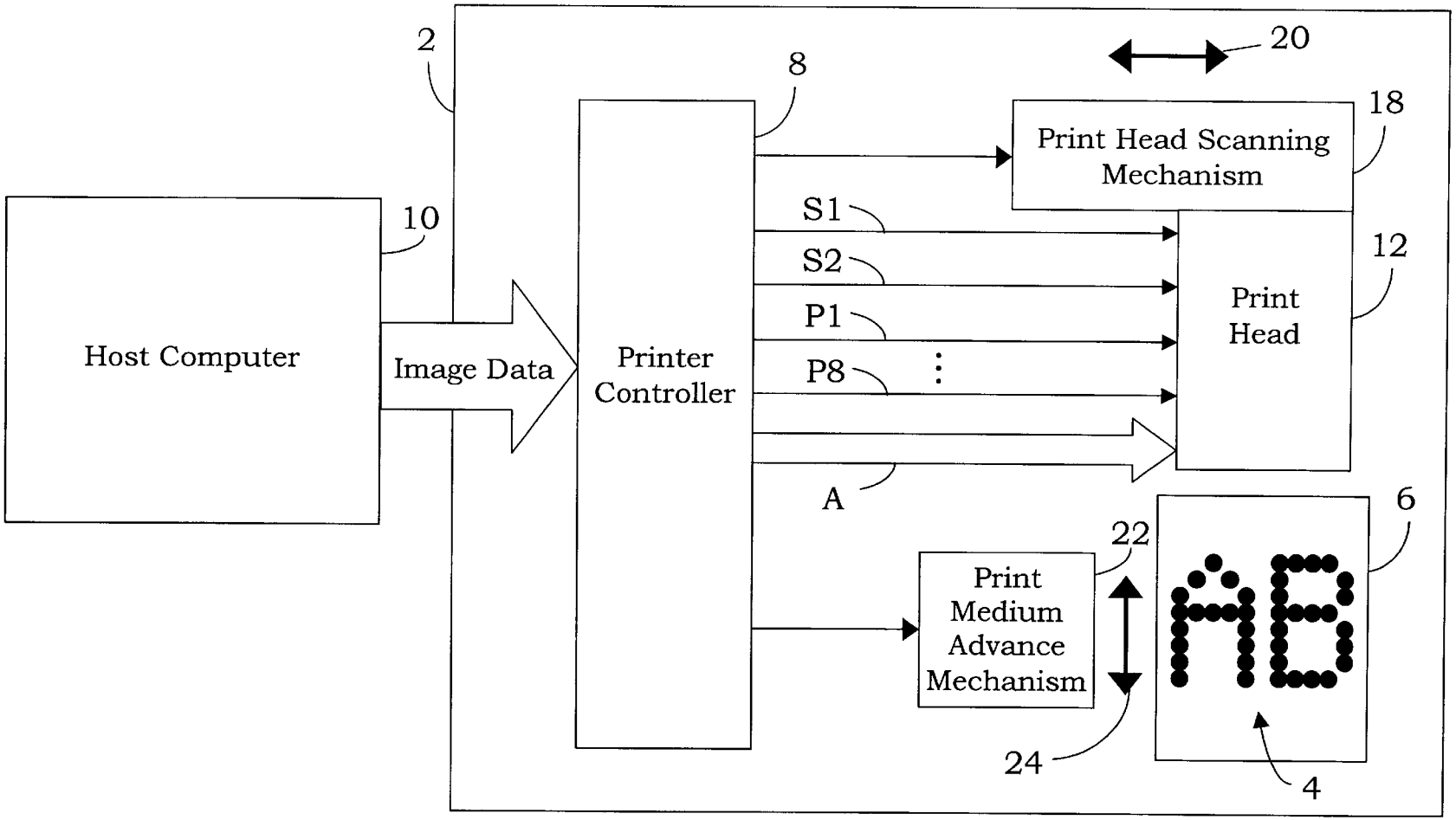
FIG. 9 is a functional block diagram of an ink jet printer according to a second embodiment of the invention.

In a second embodiment of the invention, the capability of printing the checkerboard pattern of FIG. 8 is provided by a different arrangement of nozzles N1–N320 in the nozzle plate 14, and the corresponding heating elements are activated by a different combination of print signals. As shown in FIG. 9, this second embodiment of the invention uses print signals consisting of two nozzle-select signals, eight power signals, and twenty address signals which are transferred to the print head 12 over two nozzle-select lines S1 and S2, eight power lines P1–P8, and an address bus A, respectively. The address bus of this second embodiment includes twenty address lines A1–A20. As described in more detail below, this combination of signal lines also provides for addressing the 320 heating elements (2×8×20) corresponding to the 320 nozzles.

Figure 10A:
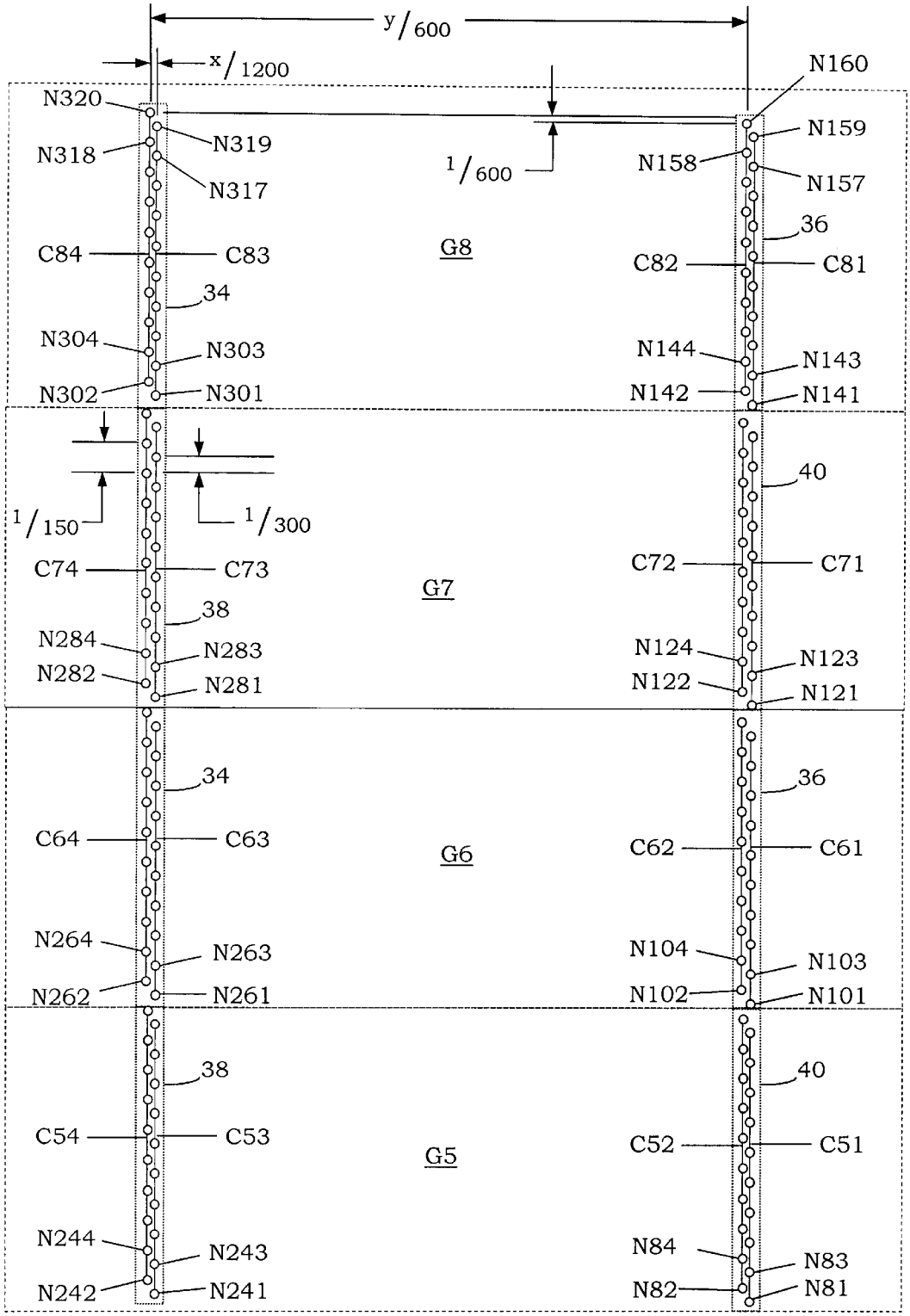
FIG. 10*a* depicts a more detailed view of the upper half of the first and second columnar arrays of ink jet nozzles according to the second embodiment of the invention.
Figure 10B:
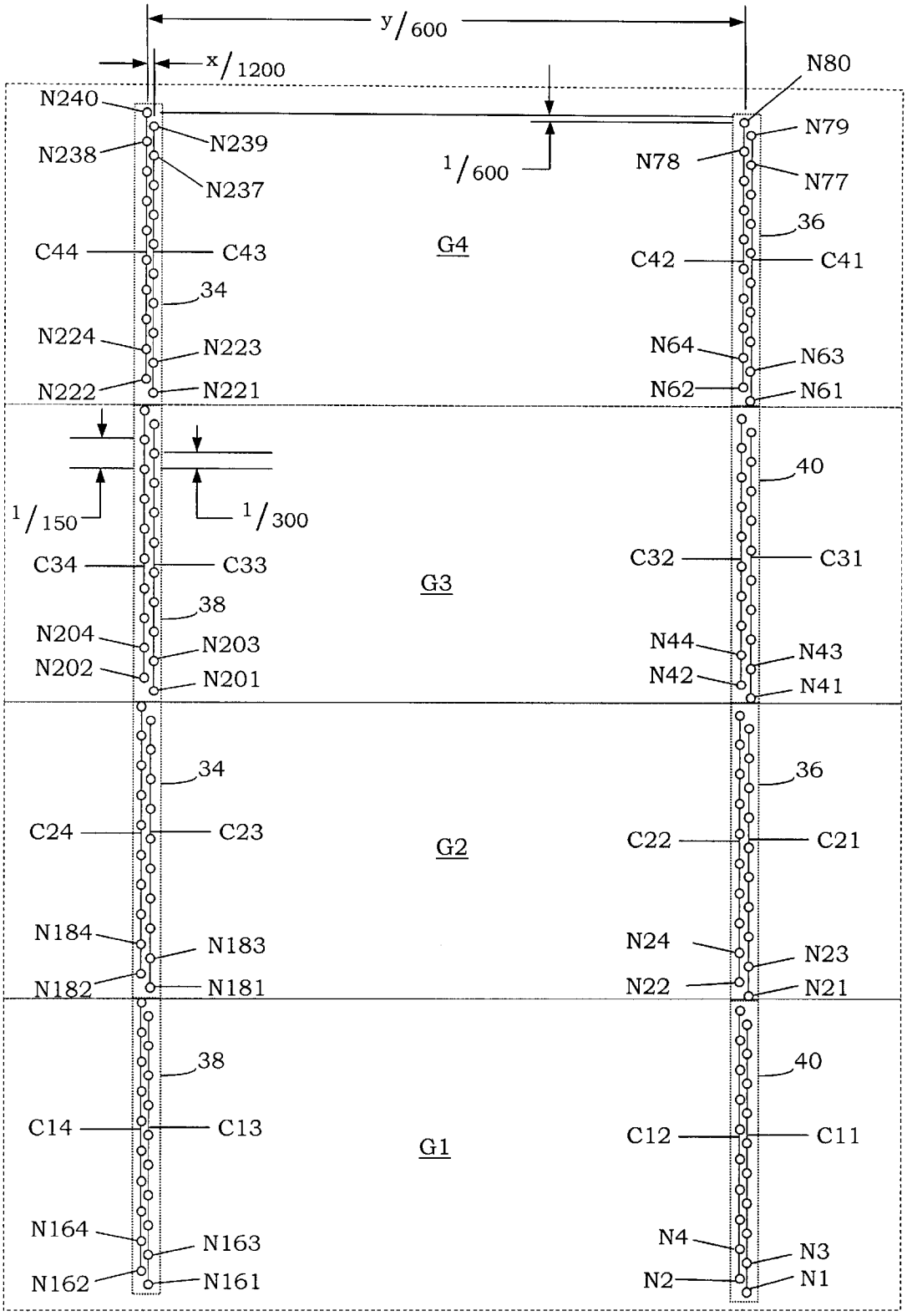
FIG. 10*b* depicts a more detailed view of the lower half of the first and second columnar arrays of ink jet nozzles according to the second embodiment of the invention.

FIGS. 10*a* and 10*b* depict the arrays 16*a* and 16*b* of the second embodiment, with FIG. 10*a* showing top half and FIG. 10*b* showing the bottom half of the arrays 16*a* and 16*b*. Arrays s 16*a* and 16*b* are horizontally separated by a second horizontal spacing of y/600 inch, where y is an even integer. In the second embodiment of the invention, y is 16. For convenience of describing the second embodiment of the invention, the arrays 16*a* and 16*b* are divided into different subarray groupings than those discussed previously in describing the first embodiment. In the second embodiment, the arrays 16*a* and 16*b* are divided into eight power groups G1–G8, with each of the power groups G1–G8 consisting of two horizontally-adjacent subarrays from each of the arrays 16*a* and 16*b*. For example, as shown in FIG. 10*b*, power group G1 consists of subarrays C11–C14, power group G2 consists of subarrays C21–C24, and so forth. Preferably, each subarray includes ten substantially collinear nozzles. The horizontal centers of horizontally-adjacent subarrays within a power group only, such as the Is subarrays C44 and C43 in FIG. 10*b*, are horizontally separated by x/1200 inch. Preferably, as in the first embodiment, x is one. Adjacent nozzles within each subarray are preferably separated by 1/150 inch, and horizontally-adjacent subarrays are vertically offset from each other by 1/300 inch. Otherwise, unlike the first embodiment, the subarrays in each power group of the second embodiment are horizontally aligned with the corresponding subarrays in each other power group.

Figure 11A:
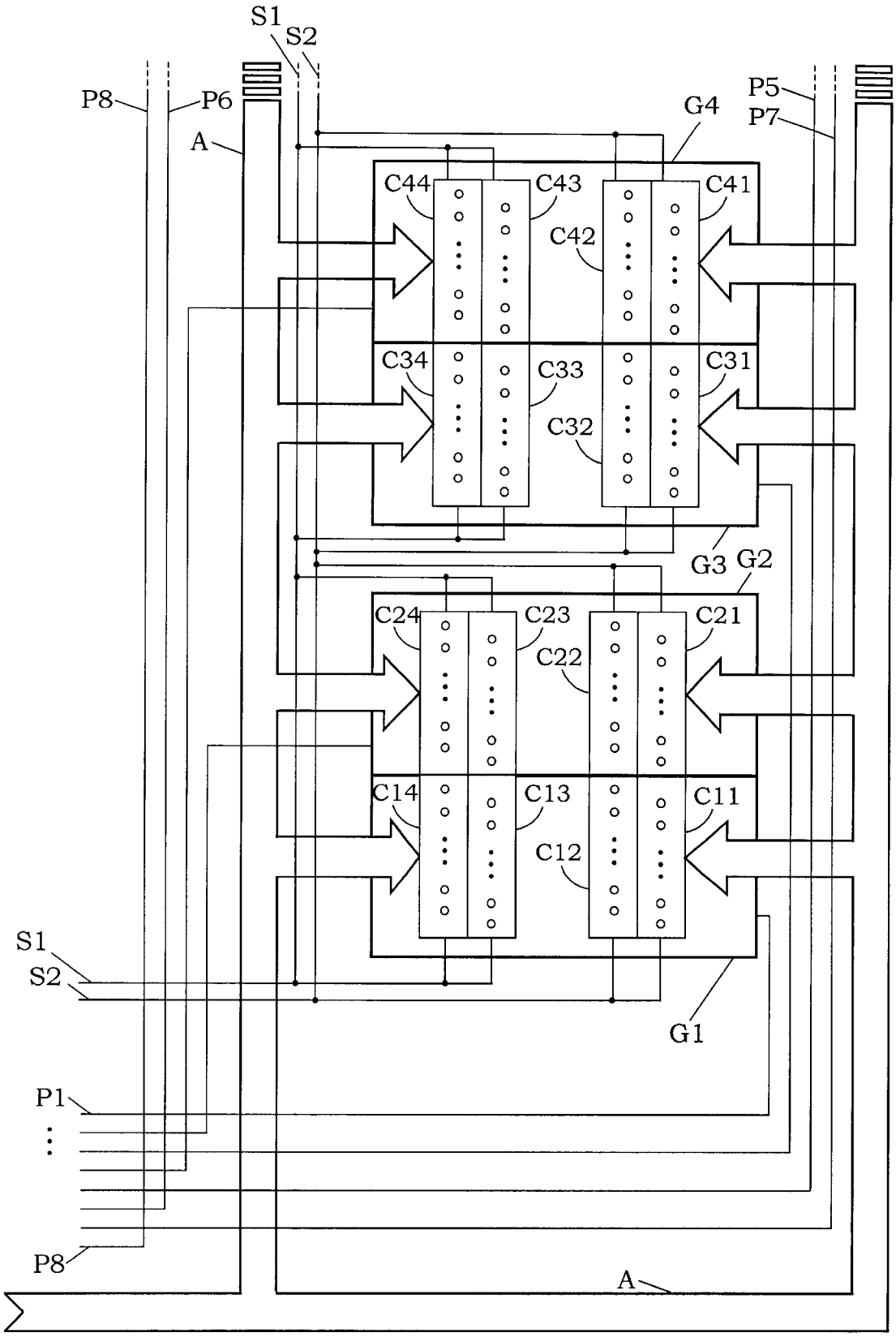
FIG. 11*a* is a functional schematic diagram showing a nozzle addressing scheme for the lower half of the first and second columnar arrays of ink jet nozzles according to the second embodiment of the invention.
Figure 11B:
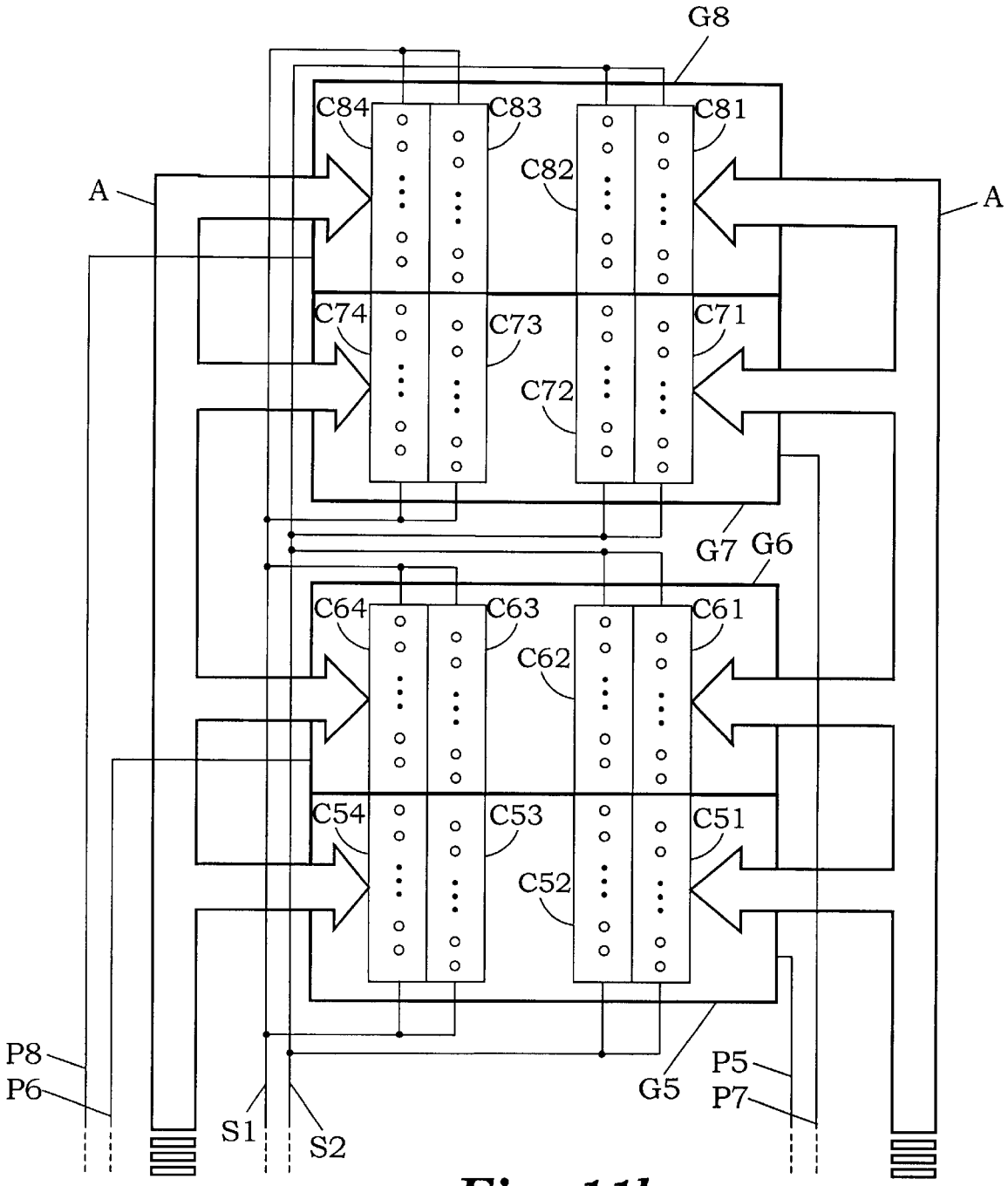
FIG. 11*b* is a functional schematic diagram showing a nozzle addressing scheme for the upper half of the first and second columnar arrays of ink jet nozzles according to the second embodiment of the invention.

Referring now to FIGS. 11*a* and 11*b*, the addressing scheme of the second embodiment is described. FIG. 11*a* depicts the connection of nozzle-select lines S1 and S2, the power lines P1–P8, and the address bus A to the power groups G1–G4, while FIG. 11*b*, which is a continuation of FIG. 11*a*, depicts the connection of the same signal lines to the power groups G5–G8. Each power group of subarrays is connected to a corresponding one of the power lines P1–P8. For example, power line P1 is connected to power group G1, power line P2 is connected to power group G2, and so forth. Nozzle-select line S1 is connected to all of the subarrays within the array 16*a*, and nozzle-select line S2 is connected to all of the subarrays within the array 16*b*.

The twenty address lines A1–A20 in the address bus A provide for individually addressing each of the twenty nozzles in each horizontally-adjacent pair of subarrays. The odd-numbered address lines A1–A19 address the odd-numbed nozzles, and the even-numbered address lines A2–A20 address the even-numbed nozzles in each of the subarray pairs. For example, the ten odd-numbered address lines A1–A19 address the ten odd-numbered nozzles N161–N179 in the subarray C13, and the ten even-numbered address lines A2–A20 address the ten even-numbered nozzles N162–N180 in the subarray C14.

Tables V and VI below correlate nozzle numbers to the nozzle-select, power, and address lines of the second embodiment.

TABLE V

| Sub- | Pwr | S1 | | | | | | | | | | | | | | | | | | | |
|---|---|---|---|---|---|---|---|---|---|---|---|---|---|---|---|---|---|---|---|---|---|
| array | Line | A1 | A2 | A3 | A4 | A5 | A6 | A7 | A8 | A9 | A10 | A11 | A12 | A13 | A14 | A15 | A16 | A17 | A18 | A19 | A20 |
| C13 C14 | P1 | 161 | 162 | 163 | 164 | 165 | 166 | 167 | 168 | 169 | 170 | 171 | 172 | 173 | 174 | 175 | 176 | 177 | 178 | 179 | 180 |
| C23 C24 | P2 | 181 | 182 | 183 | 184 | 185 | 186 | 187 | 188 | 189 | 190 | 191 | 192 | 193 | 194 | 195 | 196 | 197 | 198 | 199 | 200 |
| C33 C34 | P3 | 201 | 202 | 203 | 204 | 205 | 206 | 207 | 208 | 209 | 210 | 211 | 212 | 213 | 214 | 215 | 216 | 217 | 218 | 219 | 220 |
| C43 C44 | P4 | 221 | 222 | 223 | 224 | 225 | 226 | 227 | 228 | 229 | 230 | 231 | 232 | 233 | 234 | 235 | 236 | 237 | 238 | 239 | 240 |
| C53 C54 | P5 | 241 | 242 | 243 | 244 | 245 | 246 | 247 | 248 | 249 | 250 | 251 | 252 | 253 | 254 | 255 | 256 | 257 | 258 | 259 | 260 |
| C63 C64 | P6 | 261 | 262 | 263 | 264 | 265 | 266 | 267 | 268 | 269 | 270 | 271 | 272 | 273 | 274 | 275 | 276 | 277 | 278 | 279 | 280 |
| C73 C74 | P7 | 281 | 282 | 283 | 284 | 285 | 286 | 287 | 288 | 289 | 290 | 291 | 292 | 293 | 294 | 295 | 296 | 297 | 298 | 299 | 300 |
| C83 C84 | P8 | 301 | 302 | 303 | 304 | 305 | 306 | 307 | 308 | 309 | 310 | 311 | 312 | 313 | 314 | 315 | 316 | 317 | 318 | 319 | 320 |

TABLE VI

| Sub- | Pwr | S2 | | | | | | | | | | | | | | | | | | | |
|---|---|---|---|---|---|---|---|---|---|---|---|---|---|---|---|---|---|---|---|---|---|
| array | Line | A1 | A2 | A3 | A4 | A5 | A6 | A7 | A8 | A9 | A10 | A11 | A12 | A13 | A14 | A15 | A16 | A17 | A18 | A19 | A20 |
| C11 C12 | P1 | 1 | 2 | 3 | 4 | 5 | 6 | 7 | 8 | 9 | 10 | 11 | 12 | 13 | 14 | 15 | 16 | 17 | 18 | 19 | 20 |
| C21 C22 | P2 | 21 | 22 | 23 | 24 | 25 | 26 | 27 | 28 | 29 | 30 | 31 | 32 | 33 | 34 | 35 | 36 | 37 | 38 | 39 | 40 |
| C31 C32 | P3 | 41 | 42 | 43 | 44 | 45 | 46 | 47 | 48 | 49 | 50 | 51 | 52 | 53 | 54 | 55 | 56 | 57 | 58 | 59 | 60 |
| C41 C42 | P4 | 61 | 62 | 63 | 64 | 65 | 66 | 67 | 68 | 69 | 70 | 71 | 72 | 73 | 74 | 75 | 76 | 77 | 78 | 79 | 80 |
| C51 C52 | P5 | 81 | 82 | 83 | 84 | 85 | 86 | 87 | 88 | 89 | 90 | 91 | 92 | 93 | 94 | 95 | 96 | 97 | 98 | 99 | 100 |
| C61 C62 | P6 | 101 | 102 | 103 | 104 | 105 | 106 | 107 | 108 | 109 | 110 | 111 | 112 | 113 | 114 | 115 | 116 | 117 | 118 | 119 | 120 |
| C71 C72 | P7 | 121 | 122 | 123 | 124 | 125 | 126 | 127 | 128 | 129 | 130 | 131 | 132 | 133 | 134 | 135 | 136 | 137 | 138 | 139 | 140 |

TABLE VI-continued

| Sub- | Pwr | S2 | | | | | | | | | | | | | | | | | | | |
|---|---|---|---|---|---|---|---|---|---|---|---|---|---|---|---|---|---|---|---|---|---|
| array | Line | A1 | A2 | A3 | A4 | A5 | A6 | A7 | A8 | A9 | A10 | A11 | A12 | A13 | A14 | A15 | A16 | A17 | A18 | A19 | A20 |
| C81 C82 | P8 | 141 | 142 | 143 | 144 | 145 | 146 | 147 | 148 | 149 | 150 | 151 | 152 | 153 | 154 | 155 | 156 | 157 | 158 | 159 | 160 |

Figure 12:
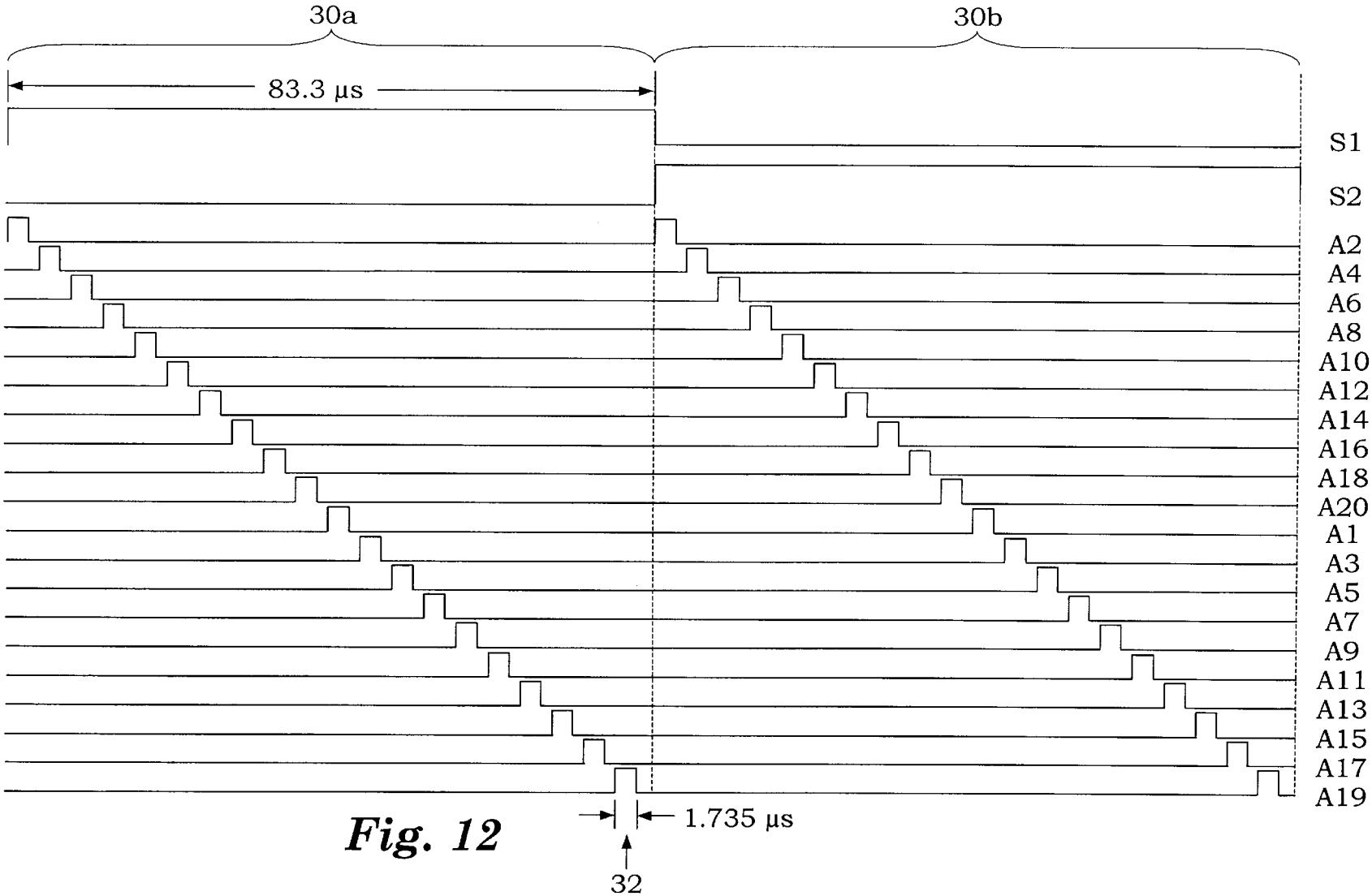
FIG. 12 is a signal timing diagram for a nozzle addressing scheme according to the second embodiment of the invention.

FIG. 12 is a timing diagram depicting the preferred signal timing scheme of the second embodiment of the invention. As shown in FIG. 12, the nozzle-select signals on the nozzle-select lines S1–S2 are high during sequential and alternating nozzle-select windows 30*a* and 30*b*. Preferably, each nozzle-select window 30*a* and 30*b* endures for approximately 83.3 μs. During each nozzle-select window 30*a* and 30*b*, each of the even-numbered address lines A2–A20 and then each of the odd-numbered address lines A1–A19 go high within sequential address windows 32 of approximately 1.735 μs duration. During any one of the address windows 32, the printer controller 8 may drive any combination of the power lines P1–P8 high, as determined by the image data.

The signal transitions shown in FIG. 12 occur as the print head scanning mechanism 18 scans the print head 12 across the print medium 6 from right to left. As the print head 12 scans from left to right, the order of the quad window transitions is reversed: first S2 is high and then S1 is high. Also, when scanning from left to right, the order in which the address lines go high is also reversed: the odd-numbered lines A19–A1 go high, and then the even-numbered lines A20–A2 go high, and so forth. In the second embodiment of the invention, the scan speed of the print head 12 is approximately 20 inch/second. Thus, during one address window 32, the print head 12 travels approximately $3.47\times10^{-5}$ inch in the scan direction. During one nozzle-select window 30*a* or 30*b*, the print head 12 travels approximately $1.67\times10^{-3}$ (1/600) inch.

Figure 13A:
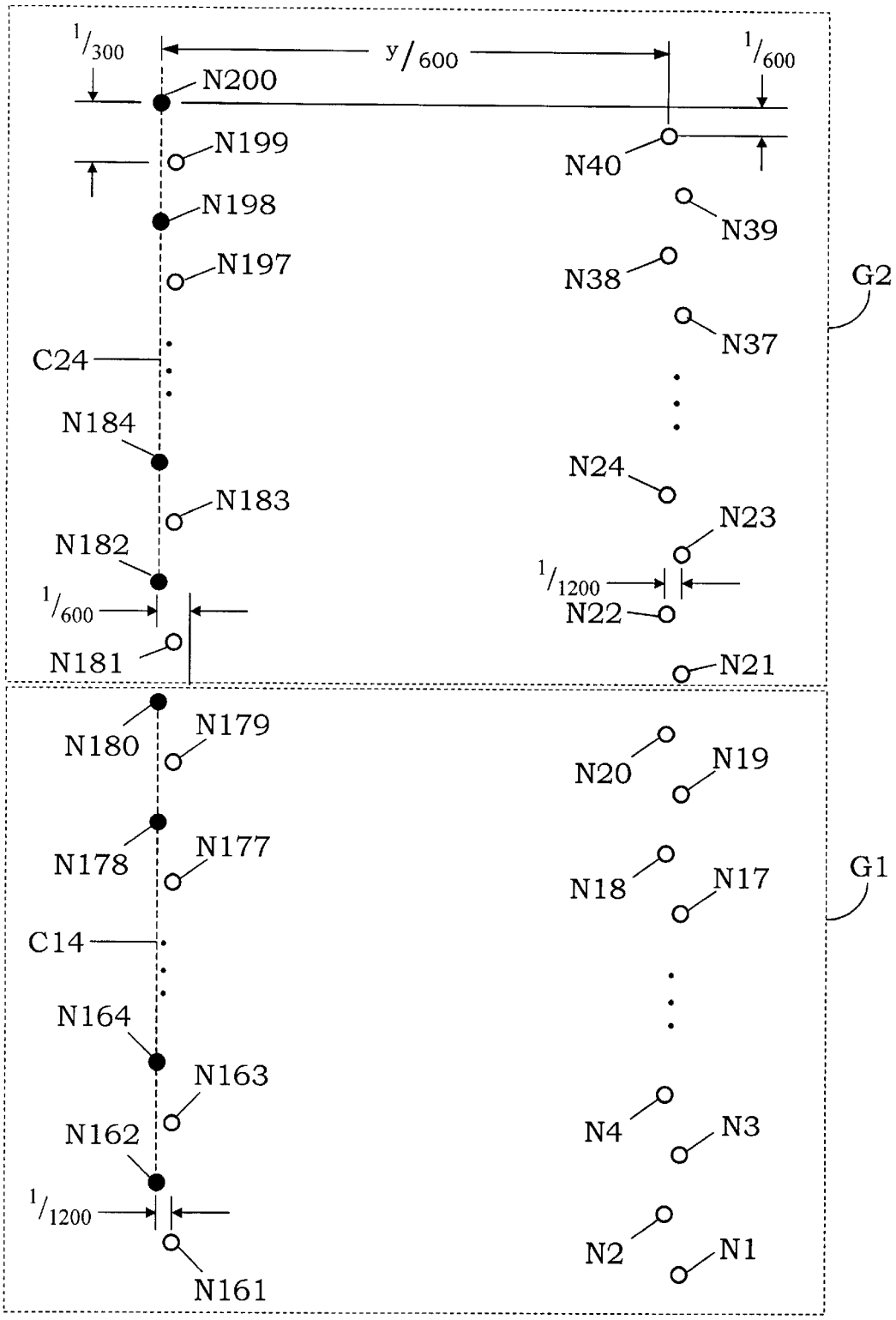
FIGS. 13*a*–13*d* depict a portion of the nozzles on the print head and indicate those nozzles that fire during sequential periods of time according to the second embodiment of the invention.

FIGS. 13*a*–13*h* depict the spatial arrangement of the nozzles within the power groups G1 and G2 and the sequence of nozzle firings which occur to print a checkerboard pattern of dots according to the second embodiment of the invention. In FIG. 13*a*, the blackened circles represent the even-numbered nozzles N162–N200 that are fired during the first half of the nozzle-select window 30*a*, while the nozzle-select line S1 is high, as the controller 8 sets the power signal high on power lines P1 and P2 during each of the first ten address windows 32. The resulting dot pattern at the completion of the first half of the nozzle-select window 30*a* is shown in FIG. 14*a*.

Figure 13B:
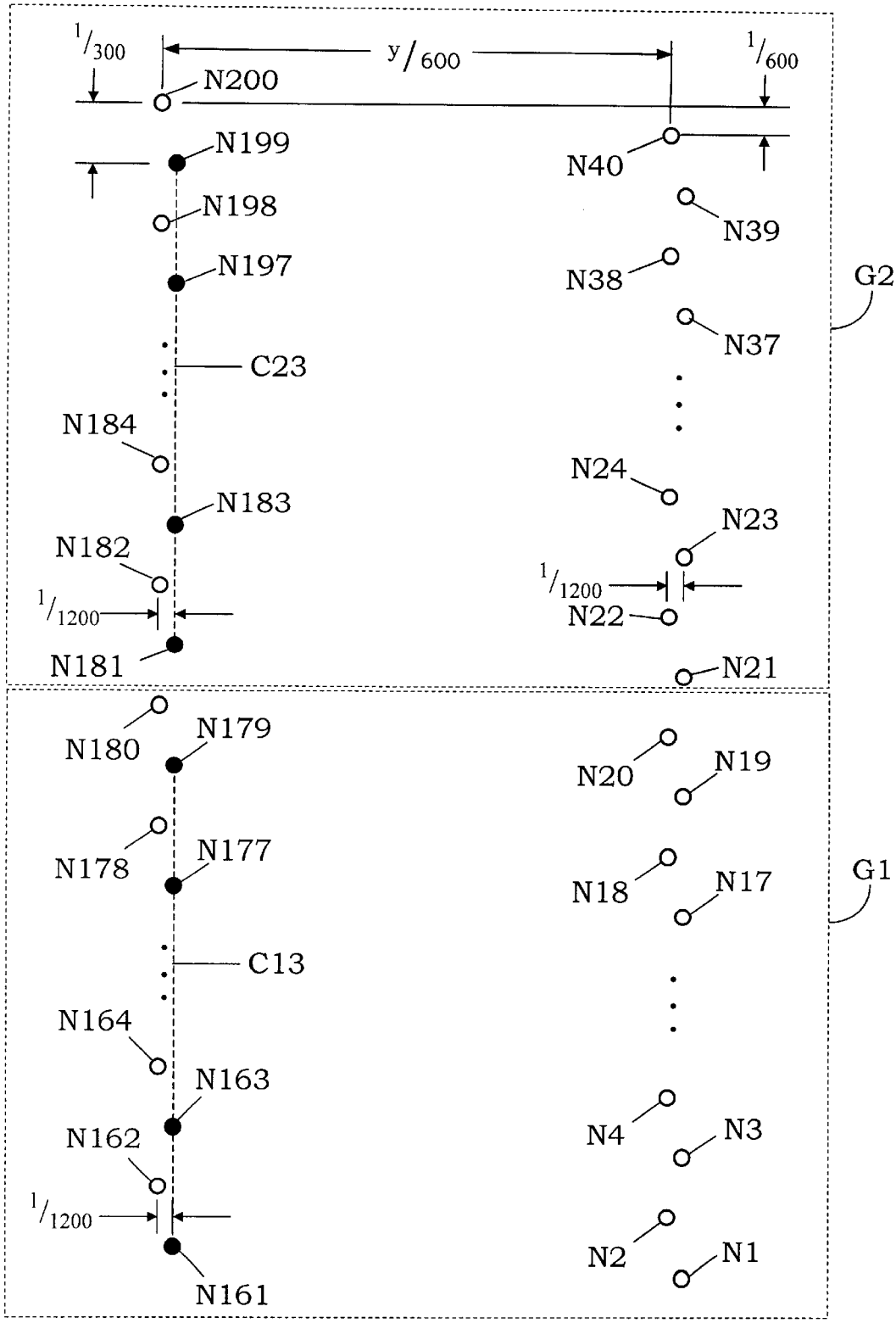
Figure 14A:
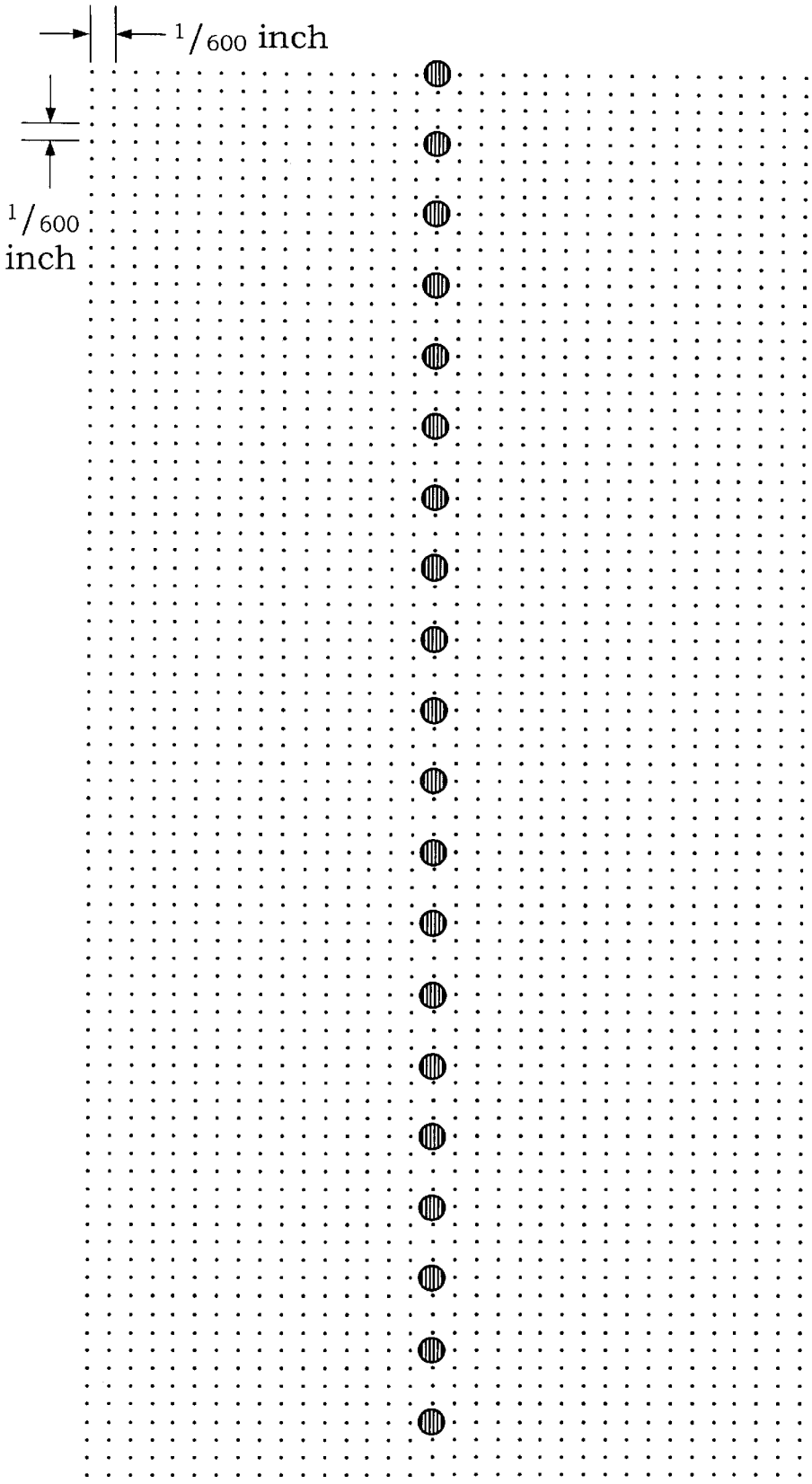
FIGS. 14*a*–14*d* depict patterns of dots that print on the print medium during sequential periods of time according to the second embodiment of the invention.

As shown in FIG. 13*b*, the subarrays C13 and C23 are offset to the right of the subarrays C14 and C24 by 1/1200 inch in the nozzle plate 14. Since the print head 12 is continuously moving during the nozzle-select window 30*a*, the print head 12 has traveled 1/1200 inch to the left by the beginning of the second half of the nozzle-select window 30*a*. Thus, at the beginning of the second half of the nozzle-select window 30*a*, the subarrays C13 and C23 are positioned over the same scan location on the print medium 6 as were the subarrays C14 and C24 at the beginning of the first half of the nozzle-select window 30*a*.

FIG. 13*b* depicts the nozzles within the power groups G1 and G2 that are fired during the second half of the nozzle-select window 30*a* to continue the printing of the checkerboard pattern. During the second half of the nozzle-select window 30*a*, the controller 8 sets the power signal high on the power lines P1 and P2 during each of the second ten address windows 32, thus firing the odd-numbered nozzles N161–N199 in subarrays C13 and C23 of the power groups G1 and G2. The nozzles of subarrays C13 and C23 that are activated during the second half of the nozzle-select window 30*b* are represented in FIG. 13*b* as the blackened circles.

Figure 14B:
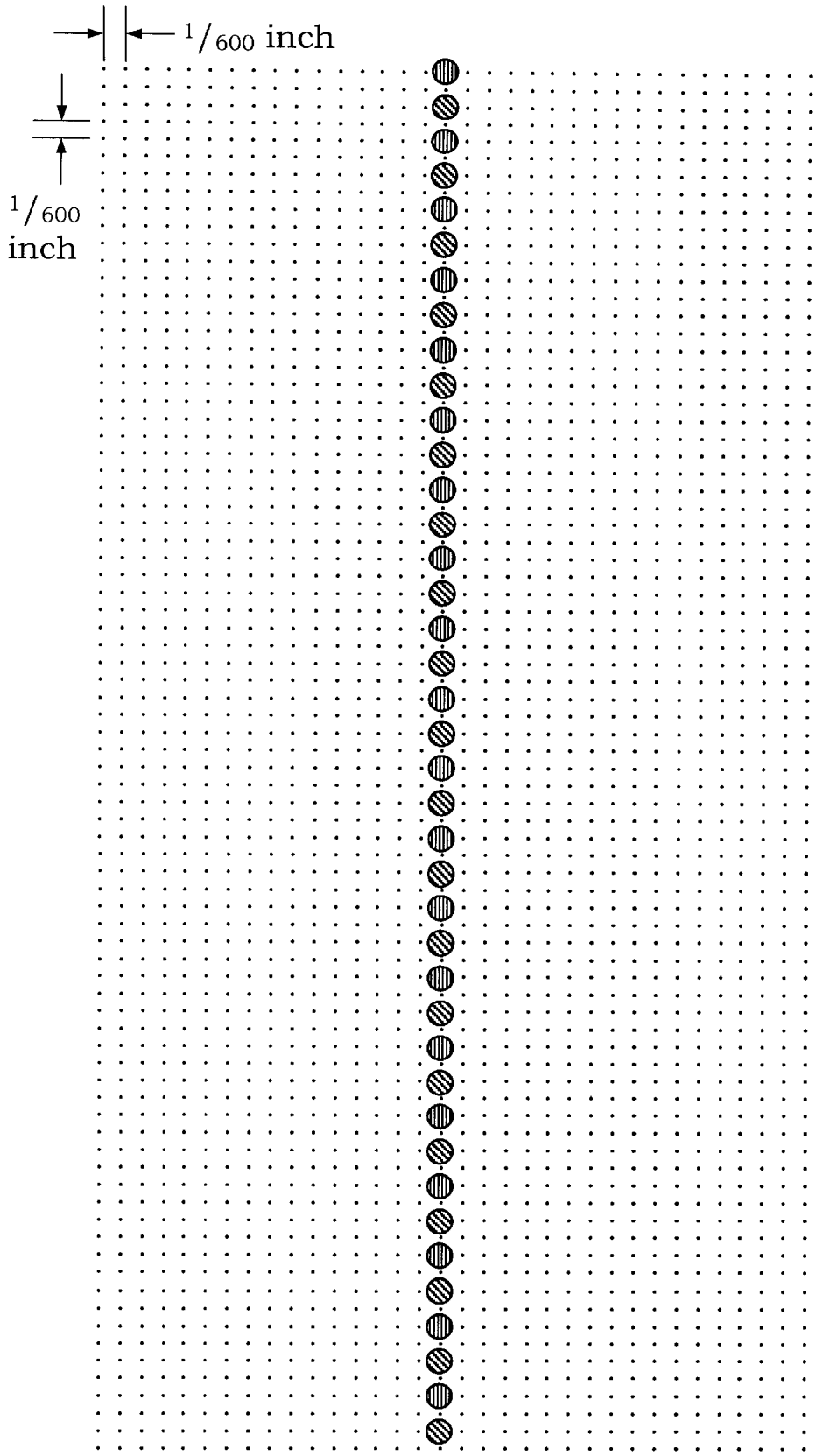

The resulting dot pattern at the completion of second half of the nozzle-select window 30*a* is shown in FIG. 14*b*. The circles filled with the diagonal hatching represent dots printed by the odd-numbered nozzles N161–N199.

Figure 13C:
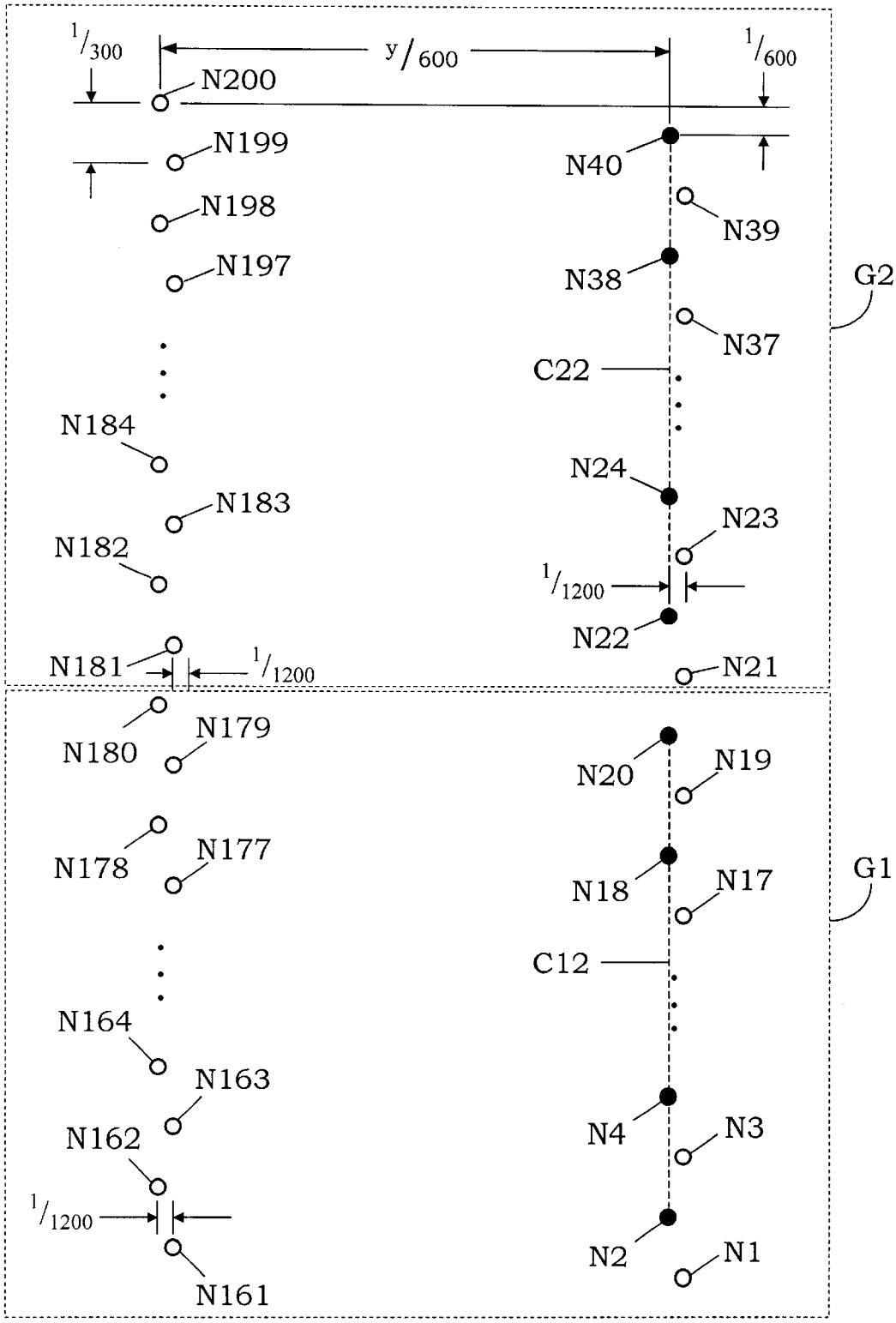

In FIG. 13*c*, the blackened circles represent the even-numbered nozzles N2–N40 that are fired during the first half of the nozzle-select window 30*b*, while the nozzle-select line S2 is high. These nozzles are fired as the controller 8 sets the power signal high on the power lines P1 and P2 during each of the first ten address windows 32.

Figure 14C:
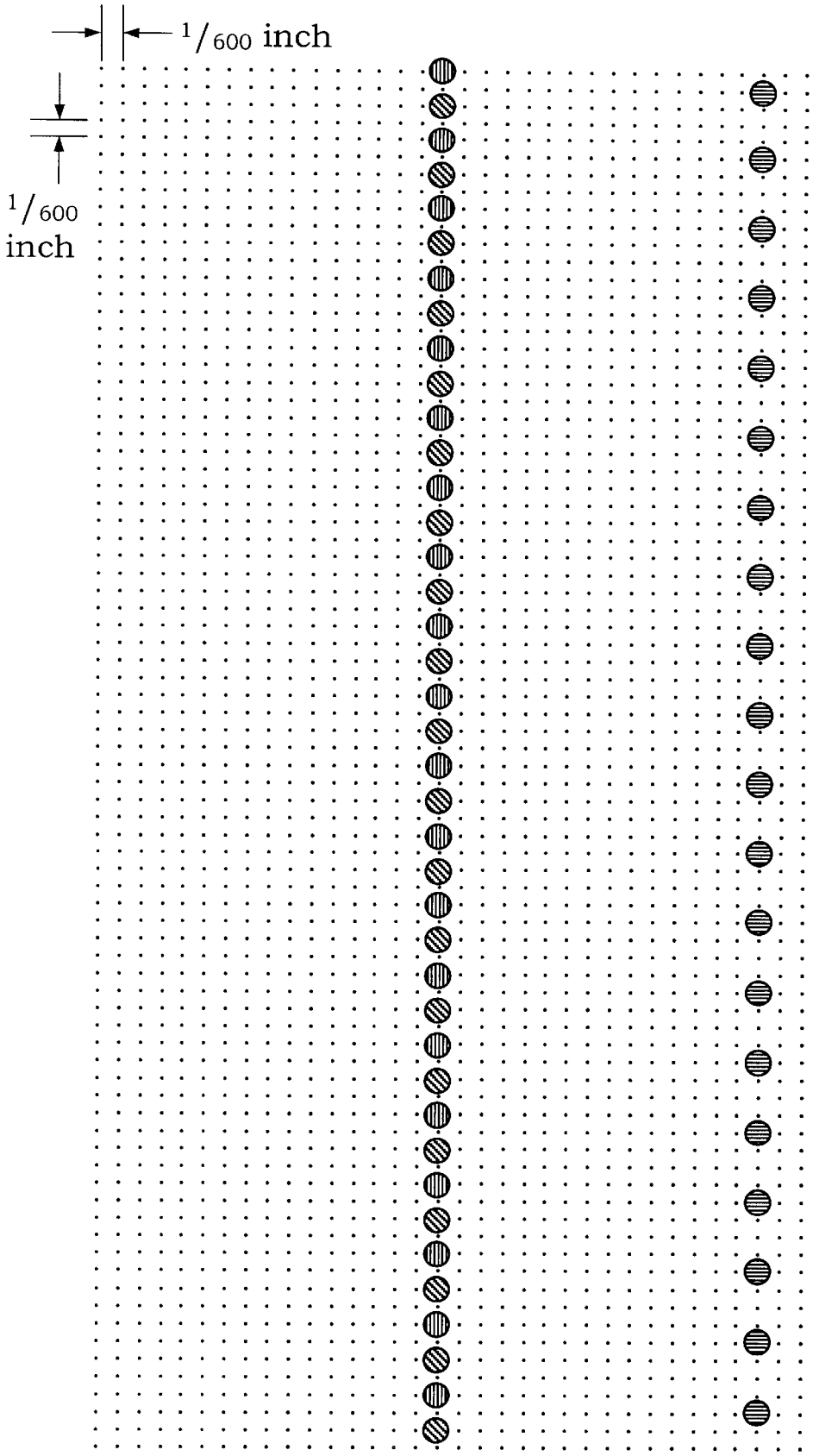

The resulting dot pattern at the completion of the first half of the nozzle-select window 30*b* is shown in FIG. 14*c*. The dots having the horizontal hatching represent the dots printed by the even-numbered nozzles N2–N40. Since the print head 12 moved to the left by 1/600 inch during the nozzle-select window 30*a*, the dots printed by the even-numbered nozzles N2–N40 are separated from the dots printed during the nozzle-select window 30*a* by 15/600 inch.

Figure 13D:
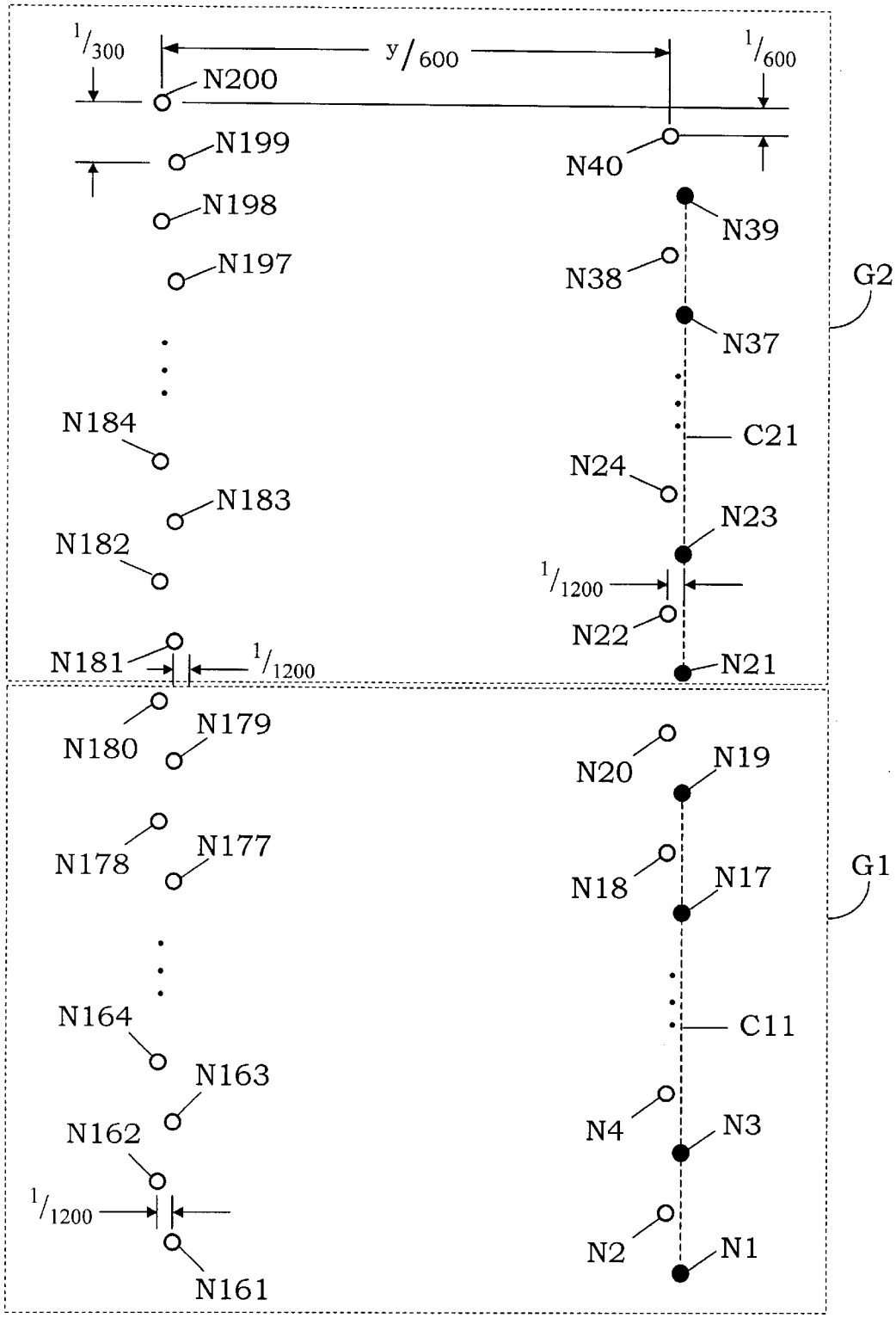

As shown in FIG. 13*d*, the subarrays C11 and C21 are offset to the right of the subarrays C12 and C22 by 1/1200 inch in the nozzle plate 14. Since the print head 12 is continuously moving during the first half of the nozzle-select window 30*b*, the print head 12 has traveled 1/1200 inch to the left by the beginning of the second half of the nozzle-select window 30*b*. Thus, at the beginning of the second half of the nozzle-select window 30*b*, the subarrays C11 and C21 are positioned over the same scan location on the print medium 6 as were the subarrays C12 and C22 at the beginning of the first half of the-nozzle-select window 30*b*.

FIG. 13*d* depicts the nozzles within the power groups G1 and G2 that are fired during the second half of the nozzle-select window 30*b* to continue the printing of the checkerboard pattern. During the second half of the nozzle-select window 30*b*, the controller 8 sets the power signal high on the power lines P1 and P2 during each of the second ten address windows 32, thus firing the odd-numbered nozzles N1–N39 in subarrays C11 and C21 of the power groups G1 and G2. The nozzles of subarrays C11 and C21 that are activated during the second half of the nozzle-select window 30*b* are represented in FIG. 13*d* as the blackened circles.

Figure 14D:
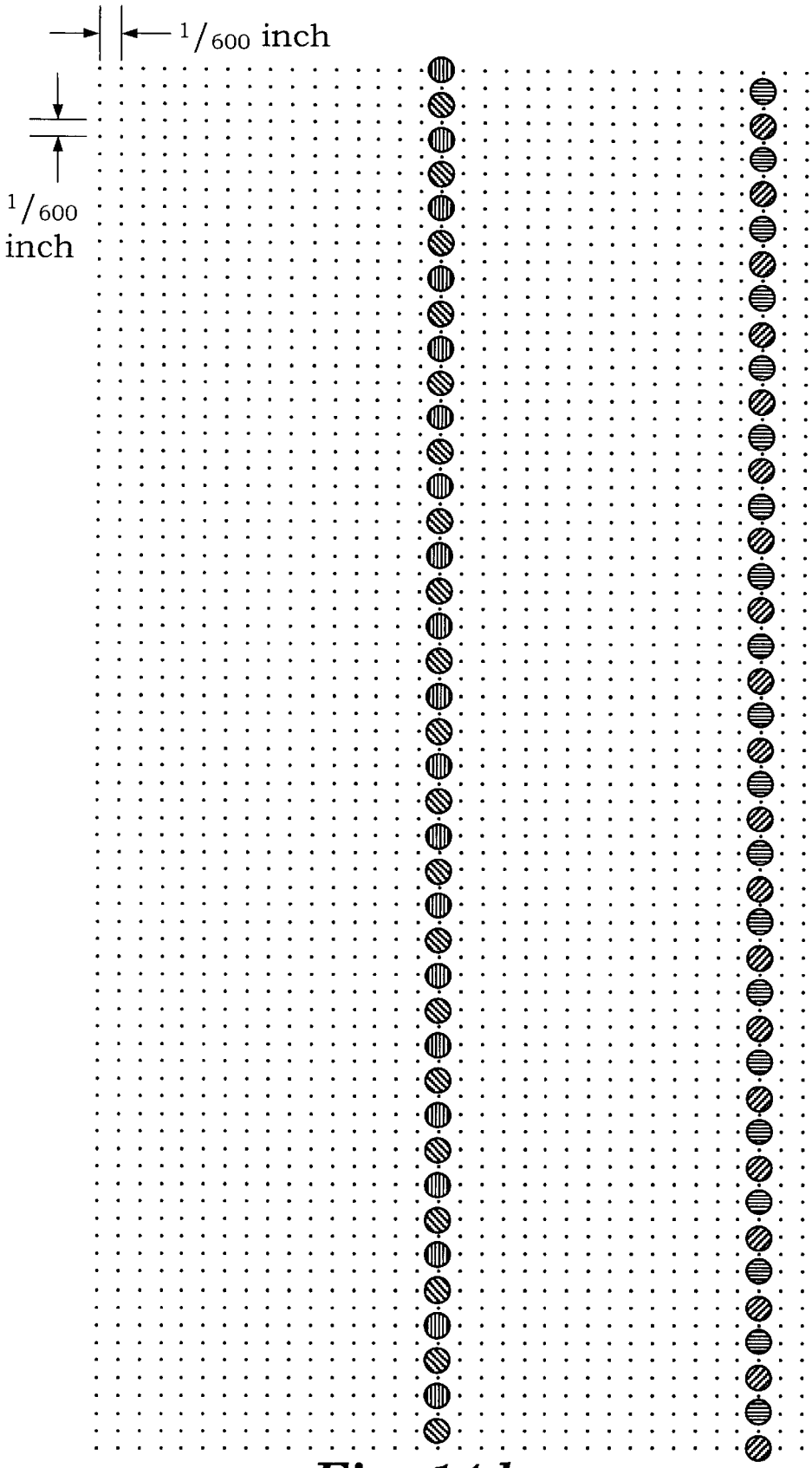

The resulting dot pattern at the completion of second half of the nozzle-select window 30*b* is shown in FIG. 14*d*. The circles filled with the diagonal hatching (interlaced with the circles having the horizontal hatching) represent dots printed by the odd-numbered nozzles N1–N39.

As the print head 12 continues to scan across the print medium 6, the process performed by the second embodiment as described above repeats. By the beginning of the next nozzle-select window 30*a*, the subarrays C23 and C24 are positioned 1/300 inch to left of where they were at the beginning of the previous nozzle-select window 30*a*. After completing fifteen cycles of the process described above, the checkerboard pattern of dots as depicted in FIG. 8 has been printed by the nozzles in power groups G1 and G2 in the bottom one-fourth of the printed swath. Thus, as does the first embodiment, the second embodiment of the invention also completely fills in the 600 dpi checkerboard pattern during a single pass of the print head 12 across the print medium 6 without any need for a movement of the print medium 6.

In the second embodiment of the invention, the spatial arrangement of nozzles in the other power groups G3–G8 is identical to that shown in FIGS. 13*a*–13*d*. Thus, while the nozzles of the power groups G1 and G2 are printing the checkerboard pattern of dots according to the process described above in the bottom one-fourth of the swath, the nozzles of the power groups G3–G4, G5–G6, and G7–G8 are printing the same pattern in the upper three-fourths of the swath.

It is contemplated, and will be apparent to those skilled in the art from the preceding description and the accompanying drawings that modifications and/or changes may be made in the embodiments of the invention. It should be appreciated that the invention is not limited to the nozzle spacings and signal timing described above. For example, the horizontal spacing between subarrays could be larger than 1/1200 inch with a corresponding increase in the time between nozzle firings in the subarrays and/or a corresponding increase in print head scan speed. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An ink jet printing apparatus for forming a printed image on a print medium based on image data, comprising:

a printer controller for receiving the image data and for generating print signals based on the image data; and an ink jet print head having a plurality of ink ejection nozzles in a nozzle array and a corresponding number of ink heating elements, the print head for receiving the print signals and selectively activating the heating elements based on the print signals to cause ink to be ejected from the corresponding nozzles and onto the print medium as the print head scans across the print medium in a scan direction, thereby forming the image on the print medium, the nozzle array comprising:

a first substantially columnar array of nozzles being aligned with a print medium advance direction which is perpendicular to the scan direction, the first array comprising:

a first upper subarray pair comprising:

a first upper left subarray of nozzles comprising a substantially linear arrangement of n number of nozzles having equal nozzle-to-nozzle spacings; and a first upper right subarray of nozzles comprising a substantially linear arrangement of n number of nozzles having equal nozzle-to-nozzle spacings, the nozzle-to-nozzle spacing in the first upper right subarray being equivalent to the nozzle-to-nozzle spacing in the first upper left subarray, the first upper right subarray being offset from the first upper left subarray in the scan direction by a first horizontal spacing and in the print medium advance direction by one-half of the nozzle-to-nozzle spacing; and a second substantially columnar array of nozzles being aligned with the print medium advance direction, the second array being offset from the first array in the scan direction by a second horizontal spacing and in the print medium advance direction by one-fourth of the nozzle-to-nozzle spacing in the first upper subarrays, the second array comprising:

a second upper subarray pair comprising:

a second upper left subarray of nozzles comprising a substantially linear arrangement of n number of nozzles having equal nozzle-to-nozzle spacings, the nozzle-to-nozzle spacings in the second upper left subarray being equivalent to the nozzle-to-nozzle spacing in the first upper left subarray; and a second upper right subarray of nozzles comprising a substantially linear arrangement of n number of nozzles having equal nozzle-to-nozzle spacings, the nozzle-to-nozzle spacing in the second upper right subarray being equivalent to the nozzle-to-nozzle spacing in the first upper right subarray, the second upper right subarray being offset from the second upper left subarray in the scan direction by the first horizontal spacing and in the print medium advance direction by one-half of the nozzle-to-nozzle spacing.

2. The apparatus of claim 1 further comprising:

the first substantially columnar array of nozzles further comprising:

a first lower subarray pair comprising:

a first lower left subarray of nozzles comprising a substantially linear arrangement of n number of nozzles having equal nozzle-to-nozzle spacings, the first lower left subarray being substantially aligned with the first upper left subarray in the scan direction and offset from the first upper left subarray in the print medium advance direction by n times the nozzle-to-nozzle spacing; and a first lower right subarray of nozzles comprising a substantially linear arrangement of n number of nozzles having equal nozzle-to-nozzle spacings, the nozzle-to-nozzle spacing in the first lower right subarray being equivalent to the nozzle-to-nozzle spacing in the first lower left subarray, the first lower right subarray being offset from the first lower left subarray in the scan direction by the first horizontal spacing and in the print medium advance direction by one-half of the nozzle-to-nozzle spacing; and the second substantially columnar array of nozzles further comprising:

a second lower subarray pair comprising:

a second lower left subarray of nozzles comprising a substantially linear arrangement of n number of nozzles having equal nozzle-to-nozzle spacings, the nozzle-to-nozzle spacings in the second lower left subarray being equivalent to the nozzle-to-nozzle spacing in the first lower left subarray, the second lower left subarray being substantially aligned with the second upper left subarray in the scan direction and offset from the second upper left subarray in the print medium advance direction by n times the nozzle-to-nozzle spacing; and a second lower right subarray of nozzles comprising a substantially linear arrangement of n number of nozzles having equal nozzle-to-nozzle spacings, the nozzle-to-nozzle spacing in the second lower right subarray being equivalent to the nozzle-to-nozzle spacing in the first lower right subarray, the second lower right subarray being offset from the second lower left subarray in the scan direction by the first horizontal spacing and in the print medium advance direction by one-half of the nozzle-to-nozzle spacing.

3. The apparatus of claim 2 further comprising:

the printer controller operable to generate the print signals to activate the heating elements to cause ink to be ejected from the nozzles in the first lower left subarray to form fifth dots in the first column on the print medium, the spacing between the fifth dots being equivalent to the nozzle-to-nozzle spacing in the first lower left subarray;

the printer controller further operable to generate the print signals to activate the heating elements to cause ink to be ejected from the nozzles in the first lower right subarray to form sixth dots in the first column that are collinear and interdigitated with the fifth dots, the spacing between the sixth dots being equivalent to the nozzle-to-nozzle spacing in the first lower right subarray;

the printer controller further operable to generate the print signals to activate the heating elements to cause ink to be ejected from the nozzles in the second lower left subarray to form seventh dots in the second column on the print medium, the spacing between the seventh dots being equivalent to the nozzle-to-nozzle spacing in the second lower left subarray; and the printer controller further operable to generate the print signals to activate the heating elements to cause ink to be ejected from the nozzles in the second lower right subarray to form eighth dots in the second column that are collinear and interdigitated with the seventh dots, the spacing between the eighth dots being equivalent to the nozzle-to-nozzle spacing in the second lower right subarray, the seventh and eighth dots being offset in the print medium advance direction from the fifth and sixth dots by one-quarter of the nozzle-to-nozzle spacing in the subarrays, and being offset in the scan direction from the fifth and sixth dots by at least one-quarter of the nozzle-to-nozzle spacing in the subarrays.

4. The apparatus of claim 2 wherein the nozzle-to-nozzle spacing in the first lower left, first lower right, second lower left, and second lower right subarrays is 1/150 inch, the second lower left subarray is offset from the first lower left subarray in the print medium advance direction by 1/600 inch, and the second lower right subarray is offset from the first lower right subarray in the print medium advance direction by 1/600 inch.

5. The apparatus of claim 2 wherein the first upper subarray pair and the second upper subarray pair together comprise a power group.

6. The apparatus of claim 2 wherein the first lower subarray pair and the second lower subarray pair together comprise a power group.

7. The apparatus of claim 2 further comprising:

the printer controller further operable to generate the print signals to activate the heating elements to cause ink to be ejected from the nozzles in the first upper left and the first lower left subarrays to form the first and fifth dots during a first period of time; and the printer controller further operable to generate the print signals to activate the heating elements to cause ink to be ejected from the nozzles in the first upper right and the first lower right subarrays to form the second and sixth dots during a second period of time which is sequential with the first period of time.

8. The apparatus of claim 7 wherein the first and second periods of time each endure for approximately 41.65 $\mu$s.

9. The apparatus of claim 2 further comprising:

the printer controller further operable to generate the print signals to activate the heating elements to cause ink to be ejected from the nozzles in the second upper left and the second lower left subarrays to form the third and seventh dots during a third period of time; and the printer controller further operable to generate the print signals to activate the heating elements to cause ink to be ejected from the nozzles in the second upper right and the second lower right subarrays to form the fourth and eighth dots during a fourth period of time which is sequential with the first period of time.

10. The apparatus of claim 9 wherein the third and fourth periods of time each endure for approximately 41.65 $\mu$s.

11. A method for printing dots on a print medium by ejecting ink droplets from nozzles on a print head as the print head scans across the print medium in a scan direction, thereby forming the image on the print medium, where the print head has a first upper left subarray of nozzles comprising n number of nozzles having equal nozzle-to-nozzle spacings that are substantially aligned in a print medium advance direction which is orthogonal to the scan direction, a first upper right subarray of nozzles comprising n number of nozzles having equal nozzle-to-nozzle spacings that are substantially aligned in the print medium advance direction, the first upper right subarray being offset from the first upper left subarray in the scan direction by a first horizontal spacing and in the print medium advance direction by one-half the nozzle-to-nozzle spacing, a second upper left subarray of nozzles comprising n number of nozzles having equal nozzle-to-nozzle spacings that are substantially aligned in the print medium advance direction, the second upper left subarray being offset from the first upper left subarray in the scan direction by a second horizontal spacing and in the print medium advance direction by one-quarter of the nozzle-to-nozzle spacing, a second upper right subarray of nozzles comprising n number of nozzles having equal nozzle-to-nozzle spacings that are substantially aligned in the print medium advance direction, the second upper right subarray being offset from the second upper left subarray in the scan direction by the first horizontal spacing and in the print medium advance direction by one-half of the nozzle-to-nozzle spacing, a first lower left subarray of nozzles comprising n number of nozzles having equal nozzle-to-nozzle spacings that are substantially aligned in the print medium advance direction, the first lower left subarray being substantially aligned with the first upper left subarray in the scan direction and being offset from the first upper left subarray in the print medium advance direction by n times the nozzle-to-nozzle spacing, a first lower right subarray of nozzles comprising n number of nozzles having equal nozzle-to-nozzle spacings that are substantially aligned in the print medium advance direction, the first lower right subarray being offset from the first lower left subarray in the scan direction by the first horizontal spacing and in the print medium advance direction by one-half the nozzle-to-nozzle spacing, a second lower left subarray of nozzles comprising n number of nozzles having equal nozzle-to-nozzle spacings that are substantially aligned in the print medium advance direction, the second lower left subarray being offset from the first lower left subarray in the scan direction by the second horizontal spacing and in the print medium advance direction by one-quarter of the nozzle-to-nozzle spacing, and a second lower right subarray of nozzles comprising n number of nozzles having equal nozzle-to-nozzle spacings that are substantially aligned in the print medium advance direction, the second lower right subarray being offset from the second lower left subarray in the scan direction by the first horizontal spacing and in the print medium advance-direction by one-half of the nozzle-to-nozzle spacing, the method comprising the steps of:

(a) during a first period of time, ejecting ink from the first upper left subarray of nozzles to form first dots in a first column on the print medium, where spacing between the first dots is equivalent to spacings between nozzles in the first upper left subarray;

(b) during the first period of time, ejecting ink from the first lower left subarray of nozzles to form fifth dots in the first column on the print medium, where spacing between the fifth dots is equivalent to spacings between nozzles in the first lower left subarray;

(c) during a second period of time, ejecting ink from the first upper right subarray of nozzles to form second dots that are collinear and interdigitated with the first dots in the first column on the print medium, where spacing between the second dots is equivalent to spacings between nozzles in the first upper right subarray;

(d) during the second period of time, ejecting ink from the first lower right subarray of nozzles to form sixth dots that are collinear and interdigitated with the fifth dots in the first column on the print medium, where spacing between the sixth dots is equivalent to spacings between nozzles in the first lower right subarray;

(e) during a third period of time, ejecting ink from the second upper left subarray of nozzles to form third dots in a second column on the print medium, where spacing between the third dots is equivalent to spacings between nozzles in the second upper left subarray;

(f) during the third period of time, ejecting ink from the second lower left subarray of nozzles to form seventh dots in the second column on the print medium, where spacing between the seventh dots is equivalent to spacings between nozzles in the second lower left subarray;

(g) during a fourth period of time, ejecting ink from the second upper right subarray of nozzles to form fourth dots that are collinear and interdigitated with the third dots in the second column on the print medium, where spacing between the fourth dots is equivalent to spacings between nozzles in the second upper right subarray; and (h) during the fourth period of time, ejecting ink from the second lower right subarray of nozzles to form eighth dots that are collinear and interdigitated with the seventh dots in the second column on the print medium, where spacing between the eighth dots is equivalent to spacings between nozzles in the second lower right subarray.

12. An ink jet printing apparatus for forming a printed image on a print medium based on image data, comprising:

a printer controller for receiving the image data and for generating print signals based on the image data; and an ink jet print head having a plurality of ink ejection nozzles in a nozzle array and a corresponding number of ink heating elements, the print head for receiving the print signals and selectively activating the heating elements based on the print signals to cause ink to be ejected from the corresponding nozzles and onto the print medium as the print head scans across the print medium in a scan direction, thereby forming the image on the print medium, the nozzle array comprising:

a first substantially columnar array of nozzles being aligned with a print medium advance direction which is perpendicular to the scan direction, the first array comprising:

a first upper subarray pair comprising:

a first upper left subarray of nozzles comprising a substantially linear arrangement of n number of nozzles having equal nozzle-to-nozzle spacings; and a first upper right subarray of nozzles comprising a substantially linear arrangement of n number of nozzles having equal nozzle-to-nozzle spacings, the nozzle-to-nozzle spacing in the first upper right subarray being equivalent to the nozzle-to-nozzle spacing in the first upper left subarray, the first upper right subarray being offset from the first upper left subarray in the scan direction by a first horizontal spacing and in the print medium advance direction by one-half of the nozzle-to-nozzle spacing; and a first lower subarray pair comprising:

a first lower left subarray of nozzles comprising a substantially linear arrangement of n number of nozzles having equal nozzle-to-nozzle spacings, the first lower left subarray being substantially aligned with the first upper left subarray in the scan direction and offset from the first upper left subarray in the print medium advance direction by n times the nozzle-to-nozzle spacing; and a first lower right subarray of nozzles comprising a substantially linear arrangement of n number of nozzles having equal nozzle-to-nozzle spacings, the nozzle-to-nozzle spacing in the first lower right subarray being equivalent to the nozzle-to-nozzle spacing in the first lower left subarray, the first lower right subarray being offset from the first lower left subarray in the scan direction by the first horizontal spacing and in the print medium advance direction by one-half of the nozzle-to-nozzle spacing; and a second substantially columnar array of nozzles being aligned with the print medium advance direction, the second array being offset from the first array in the scan direction by a second horizontal spacing and in the print medium advance direction by one-fourth of the nozzle-to-nozzle spacing in the first upper subarrays, the second array comprising:

a second upper subarray pair comprising:

a second upper left subarray of nozzles comprising a substantially linear arrangement of n number of nozzles having equal nozzle-to-nozzle spacings, the nozzle-to-nozzle spacings in the second upper left subarray being equivalent to the nozzle-to-nozzle spacing in the first upper left subarray, and a second upper right subarray of nozzles comprising a substantially linear arrangement of n number of nozzles having equal nozzle-to-nozzle spacings, the nozzle-to-nozzle spacing in the second upper right subarray being equivalent to the nozzle-to-nozzle spacing in the first upper right subarray, the second upper right subarray being offset from the second upper left subarray in the scan direction by the first horizontal spacing and in the print medium advance direction by one-half of the nozzle-to-nozzle spacing, and a second lower subarray pair comprising:

a second lower left subarray of nozzles comprising a substantially linear arrangement of n number of nozzles having equal nozzle-to-nozzle spacings, the nozzle-to-nozzle spacings in the second lower left subarray being equivalent to the nozzle-to-nozzle spacing in the first lower left subarray, the second lower left subarray being substantially aligned with the second upper left subarray in the scan direction and offset from the second upper left subarray in the print medium advance direction by n times the nozzle-to-nozzle spacing; and a second lower right subarray of nozzles comprising a substantially linear arrangement of n number of nozzles having equal nozzle-to-nozzle spacings, the nozzle-to-nozzle spacing in the second lower right subarray being equivalent to the nozzle-to-nozzle spacing in the first lower right subarray, the second lower right subarray being offset from the second lower left subarray in the scan direction by the first horizontal spacing and in the print medium advance direction by one-half of the nozzle-to-nozzle spacing, wherein the first upper subarray pair and the second upper subarray pair together comprise a first power group, and wherein the first lower subarray pair and the second lower subarray pair together comprise a second power group.

* * * * *